US009114294B2

(12) United States Patent
Clausen et al.

(10) Patent No.: US 9,114,294 B2
(45) **Date of Patent: *Aug. 25, 2015**

(54) DISTANCE GAPPING GOLF CLUB SET WITH DUAL-RANGE CLUB

(75) Inventors: Karl A. Clausen, Carlsbad, CA (US); Thomas W. Preece, Carlsbad, CA (US); Douglas E. Roberts, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 170 days.

This patent is subject to a terminal disclaimer.

(21) Appl. No.: 13/565,146

(22) Filed: Aug. 2, 2012

(65) Prior Publication Data

US 2013/0225311 A1 Aug. 29, 2013

Related U.S. Application Data

(63) Continuation-in-part of application No. 13/407,011, filed on Feb. 28, 2012.

(51) Int. Cl.

| | |
|---|---|
| ***A63B 53/00*** | (2006.01) |
| ***A63B 53/06*** | (2015.01) |
| ***A63B 59/00*** | (2015.01) |
| ***A63B 53/04*** | (2015.01) |
| ***A63B 49/06*** | (2006.01) |

(52) U.S. Cl.

CPC ..... *A63B 53/06* (2013.01); *A63B 49/06* (2013.01); *A63B 53/0466* (2013.01); *A63B 59/0074* (2013.01); *A63B 53/047* (2013.01); *A63B 2053/045* (2013.01); *A63B 2053/0408* (2013.01); *A63B 2053/0433* (2013.01); *A63B 2053/0462* (2013.01); *A63B 2209/10* (2013.01); *A63B 2225/01* (2013.01); *A63B 2225/20* (2013.01)

(58) Field of Classification Search

USPC ..... 473/328, 345, 344

See application file for complete search history.

(56) References Cited

U.S. PATENT DOCUMENTS

| | | | |
|---|---|---|---|
| 1,528,190 | A | 7/1923 | Howe |
| 1,709,546 | A | 4/1929 | Stanton |
| 2,004,968 | A | 6/1935 | Young |
| 2,014,829 | A | 9/1935 | Young |
| 2,178,872 | A | 3/1939 | Engstrom |

(Continued)

FOREIGN PATENT DOCUMENTS

| | | | |
|---|---|---|---|
| JP | 2005168998 | A | 6/2005 |

OTHER PUBLICATIONS

Non-final Office Action dated Apr. 25, 2014, from USPTO in U.S. Appl. No. 13/407,011, filed Feb. 28, 2012 (25 pages).

(Continued)

*Primary Examiner* — Gene Kim
*Assistant Examiner* — Matthew B Stanczak
(74) *Attorney, Agent, or Firm* — Brown Rudnick LLP

(57) ABSTRACT

This application generally relates to sets of golf clubs including at least one adjustable club to provide a set with no distance gap. The adjustable club may include a loft-adjustment mechanism and a mechanism to prevent unintended face-angle change. The club is reliable for shots covering the full range of distances associated with multiple loft settings. Thus, an adjustable club can be included in a golfer's golf bag and can play double-duty in terms of the ranges of shot distances it is reliably useful for. In this way, the golfer's bag can contain fourteen clubs that cover all desired ranges between the putter and the driver.

5 Claims, 22 Drawing Sheets

(56) References Cited

U.S. PATENT DOCUMENTS

| | | | | |
|---|---|---|---|---|
| 2,301,369 | A | 11/1942 | Carvill | |
| 2,593,368 | A | 4/1952 | Verderber | |
| 3,589,731 | A | 6/1971 | Chancellor, Jr. | |
| 3,625,518 | A * | 12/1971 | Solheim | 473/330 |
| 3,791,652 | A | 2/1974 | Schuler | |
| 3,815,921 | A | 6/1974 | Turner | |
| 3,984,103 | A * | 10/1976 | Nix | 473/291 |
| 4,139,196 | A | 2/1979 | Riley | |
| 4,239,216 | A | 12/1980 | Bauer | |
| 4,498,673 | A * | 2/1985 | Swanson | 473/328 |
| 4,600,195 | A | 7/1986 | Hunter | |
| 4,671,513 | A * | 6/1987 | Swanson | 473/328 |
| 4,735,414 | A | 4/1988 | Williams | |
| 4,756,534 | A | 7/1988 | Thompson | |
| 4,804,184 | A | 2/1989 | Maltby | |
| 4,988,102 | A | 1/1991 | Reisner | |
| 5,213,329 | A | 5/1993 | Okumoto et al. | |
| 5,326,105 | A | 7/1994 | Fenton, Jr. | |
| 5,351,952 | A | 10/1994 | Hackman | |
| 5,441,256 | A | 8/1995 | Hackman | |
| 5,573,469 | A | 11/1996 | Dekura | |
| 5,632,695 | A | 5/1997 | Hlinka et al. | |
| 5,766,088 | A | 6/1998 | Severtsen | |
| 5,779,565 | A | 7/1998 | Adams | |
| 5,800,281 | A | 9/1998 | Gilbert | |
| 5,931,745 | A | 8/1999 | Adams | |
| 6,073,086 | A | 6/2000 | Marinelli | |
| 6,083,123 | A | 7/2000 | Wood | |
| 6,093,113 | A | 7/2000 | Mertens | |
| 6,251,028 | B1 | 6/2001 | Jackson | |
| 6,366,205 | B1 | 4/2002 | Sutphen | |
| 6,447,405 | B1 * | 9/2002 | Chen | 473/328 |
| 6,471,601 | B1 | 10/2002 | McCabe et al. | |
| 6,517,352 | B2 | 2/2003 | Smith | |
| 6,569,029 | B1 | 5/2003 | Hamburger | |
| 6,719,648 | B1 | 4/2004 | Smith | |
| 6,753,778 | B2 | 6/2004 | Kruger | |
| 6,830,519 | B2 * | 12/2004 | Reed et al. | 473/290 |
| 6,860,818 | B2 | 3/2005 | Mahaffey | |
| 7,160,200 | B2 | 1/2007 | Grober | |
| 7,228,670 | B2 | 6/2007 | Ollman | |
| 7,311,612 | B2 | 12/2007 | DeLucia | |
| 7,396,296 | B2 | 7/2008 | Evans | |
| 7,476,160 | B2 | 1/2009 | Hocknell et al. | |
| 7,648,426 | B2 | 1/2010 | Evans | |
| 7,672,781 | B2 | 3/2010 | Churchill et al. | |
| 7,699,717 | B2 | 4/2010 | Morris et al. | |
| 7,704,155 | B2 * | 4/2010 | Bennett et al. | 473/245 |
| 7,803,065 | B2 | 9/2010 | Breier et al. | |
| 7,837,577 | B2 | 11/2010 | Evans | |
| 7,878,921 | B2 | 2/2011 | Bennett | |
| 7,934,999 | B2 * | 5/2011 | Cackett et al. | 473/242 |
| 7,967,695 | B2 | 6/2011 | Voges | |
| 8,012,034 | B1 | 9/2011 | Cackett et al. | |
| 8,142,304 | B2 | 3/2012 | Reeves | |
| 8,226,501 | B2 * | 7/2012 | Stites et al. | 473/349 |
| 8,253,586 | B1 | 8/2012 | Matak | |
| 8,303,429 | B2 | 11/2012 | Cackett et al. | |
| 8,371,962 | B2 | 2/2013 | Solheim et al. | |
| 8,430,764 | B2 | 4/2013 | Bennett et al. | |
| 8,496,543 | B2 | 7/2013 | Cackett et al. | |
| 8,517,850 | B1 | 8/2013 | Beno et al. | |
| 8,517,851 | B2 | 8/2013 | Cackett et al. | |
| 8,579,731 | B2 | 11/2013 | Gadiyar et al. | |
| 2003/0008731 | A1 | 1/2003 | Anderson et al. | |
| 2003/0104876 | A1 | 6/2003 | Sosin | |
| 2004/0087384 | A1 | 5/2004 | Sosin | |
| 2004/0214655 | A1 * | 10/2004 | Reed et al. | 473/290 |
| 2005/0272516 | A1 | 12/2005 | Gobush | |
| 2006/0094527 | A1 * | 5/2006 | Evans | 473/328 |
| 2006/0166737 | A1 | 7/2006 | Bentley | |
| 2006/0255918 | A1 | 11/2006 | Bernstein et al. | |
| 2006/0261938 | A1 | 11/2006 | Lai et al. | |
| 2007/0072696 | A1 | 3/2007 | Chen | |
| 2007/0149310 | A1 * | 6/2007 | Bennett et al. | 473/328 |
| 2007/0149315 | A1 * | 6/2007 | Bennett et al. | 473/334 |
| 2007/0270214 | A1 | 11/2007 | Bentley | |
| 2008/0020861 | A1 | 1/2008 | Adams et al. | |
| 2008/0125239 | A1 | 5/2008 | Clausen et al. | |
| 2008/0227564 | A1 | 9/2008 | Breier et al. | |
| 2008/0254909 | A1 | 10/2008 | Callinan et al. | |
| 2009/0017944 | A1 | 1/2009 | Savarese et al. | |
| 2009/0088275 | A1 | 4/2009 | Solheim et al. | |
| 2009/0124410 | A1 | 5/2009 | Rife | |
| 2009/0197694 | A1 | 8/2009 | Soracco et al. | |
| 2009/0215551 | A1 | 8/2009 | Liang et al. | |
| 2009/0233735 | A1 | 9/2009 | Savarese et al. | |
| 2009/0239673 | A1 | 9/2009 | Drimer | |
| 2009/0247316 | A1 | 10/2009 | De La Cruz et al. | |
| 2009/0264214 | A1 | 10/2009 | De La Cruz et al. | |
| 2009/0326688 | A1 | 12/2009 | Thomas et al. | |
| 2010/0056297 | A1 | 3/2010 | Roach et al. | |
| 2010/0105499 | A1 | 4/2010 | Roach et al. | |
| 2010/0113174 | A1 | 5/2010 | Ahern | |
| 2010/0261543 | A1 | 10/2010 | Breier et al. | |
| 2010/0292018 | A1 | 11/2010 | Cackett et al. | |
| 2010/0298065 | A1 | 11/2010 | Soracco et al. | |
| 2010/0308105 | A1 | 12/2010 | Savarese et al. | |
| 2010/0323811 | A1 | 12/2010 | Mickelson et al. | |
| 2011/0028230 | A1 | 2/2011 | Balardeta et al. | |
| 2011/0039637 | A1 | 2/2011 | Cackett et al. | |
| 2011/0053702 | A1 | 3/2011 | Stites et al. | |
| 2011/0053703 | A1 | 3/2011 | Stites et al. | |
| 2011/0143854 | A1 | 6/2011 | Bennett et al. | |
| 2011/0151989 | A1 | 6/2011 | Golden et al. | |
| 2011/0152003 | A1 | 6/2011 | Hartwell et al. | |
| 2011/0190070 | A1 | 8/2011 | Morris et al. | |
| 2011/0207560 | A1 | 8/2011 | Wright et al. | |
| 2011/0275455 | A1 | 11/2011 | Soracco | |
| 2011/0277313 | A1 | 11/2011 | Soracco et al. | |
| 2011/0304460 | A1 | 12/2011 | Keecheril et al. | |
| 2011/0305369 | A1 | 12/2011 | Bentley et al. | |
| 2011/0312436 | A1 | 12/2011 | Cackett et al. | |
| 2012/0035003 | A1 | 2/2012 | Moran et al. | |
| 2012/0050529 | A1 | 3/2012 | Bentley | |
| 2012/0052971 | A1 | 3/2012 | Bentley | |
| 2012/0052972 | A1 | 3/2012 | Bentley | |
| 2012/0052973 | A1 | 3/2012 | Bentley | |
| 2012/0116548 | A1 | 5/2012 | Goree et al. | |
| 2012/0120572 | A1 | 5/2012 | Bentley | |
| 2012/0120573 | A1 | 5/2012 | Bentley | |
| 2012/0122574 | A1 | 5/2012 | Fitzpatrick et al. | |
| 2012/0122603 | A1 | 5/2012 | Cackett et al. | |
| 2012/0139729 | A1 | 6/2012 | Savarese et al. | |
| 2012/0196692 | A1 | 8/2012 | Beck et al. | |
| 2012/0202610 | A1 | 8/2012 | Voges et al. | |
| 2012/0215474 | A1 | 8/2012 | Bentley et al. | |
| 2012/0249330 | A1 | 10/2012 | Savarese et al. | |
| 2012/0256731 | A1 | 10/2012 | Luciano, Jr. et al. | |
| 2012/0276851 | A1 | 11/2012 | Layne, IV et al. | |
| 2012/0277015 | A1 | 11/2012 | Boyd et al. | |
| 2012/0277018 | A1 | 11/2012 | Boyd et al. | |
| 2012/0295726 | A1 | 11/2012 | Cherbini | |
| 2012/0316843 | A1 | 12/2012 | Beno et al. | |
| 2012/0322569 | A1 | 12/2012 | Cottam | |
| 2012/0331058 | A1 | 12/2012 | Huston et al. | |
| 2013/0012334 | A1 | 1/2013 | Stites et al. | |
| 2013/0029783 | A1 | 1/2013 | Kimizuka et al. | |
| 2013/0063432 | A1 | 3/2013 | Kaps et al. | |
| 2013/0095941 | A1 | 4/2013 | Bentley et al. | |
| 2013/0203517 | A1 | 8/2013 | Bolane et al. | |
| 2013/0225317 | A1 | 8/2013 | Clausen et al. | |

OTHER PUBLICATIONS

Document containing machine translation of Japanese patent publication No. 2005-168998A to Kato provided by USPTO along with non-final Office Action of Apr. 25, 2014, in U.S. Appl. No. 13/407,011, filed Feb. 28, 2012 (10 pages).

* cited by examiner

DISTANCE GAPPING GOLF CLUB SET WITH DUAL-RANGE CLUB

CROSS-REFERENCE TO RELATED APPLICATION

This application is a continuation-in-part of U.S. patent application Ser. No. 13/407,011, filed Feb. 28, 2012, the contents of which are hereby incorporated by reference in their entirety.

FIELD OF THE INVENTION

This application generally relates to sets of golf clubs including at least one adjustable club to provide a set with no distance gap.

BACKGROUND

A set of golf clubs will typically include 14 clubs, each intended for hitting the golf ball a certain range. For example, a golfer may have a driver, a 2 wood, a 5 wood, 3-9 irons, 3 wedges, and a putter. The variations are as numerous as the temperaments of the players. Some golfers will have a driver, a wood, a hybrid, six irons, four wedges, and a putter.

Drivers are used for very long shots—drives—off the tee whereas wedges are used for short shots. With a given club, a golfer will be able to reliably make good shots over a certain range of distances. While the precise numbers will vary from golfer to golfer, Table 1 lists an exemplary set of golf clubs and, for each, shows the distance range within which the club will perform reliably for the golfer.

TABLE 1

Distance range for reliable shots by club for a hypothetical golfer

| Club | Distance range (yards) | Club | Distance range |
|---|---|---|---|
| 1 wood (driver) | 225-260 | 8 iron | 125-135 |
| 3 wood | 205-225 | 9 iron | 115-125 |
| 5 wood | 185-205 | Pitch wedge | 105-115 |
| 3 iron | 175-185 | Gap wedge | 95-105 |
| 4 iron | 165-175 | Sand wedge | 85-95 |
| 5 iron | 155-165 | Lob wedge | 75-85 |
| 6 iron | 145-155 | Putter | On the green |
| 7 iron | 135-145 | | |

As can be seen from Table 1, club designers have engineered clubs that, taken as a set, provide reliable performance over a wide range of distances.

However, Table 1 lists 15 clubs and PGA rules allow 14 clubs in a set. So choosing a set of golf clubs requires choosing a range of distances for which your clubs provide poor coverage. For example, many golfers will choose to have all the clubs listed in Table 1 but the 5 wood. The hypothetical golfer of Table 1, leaving behind their 5 wood, would have no club well-suited to 200 yard shots.

Some golfers may try to fill their distance gap by using a hybrid. Table 1 shows an exemplary club set including two hybrids, and a set of ranges that a hypothetical golfer may be able to reliably hit the ball using those clubs.

TABLE 2

Distance range for reliable shots by club for a hypothetical golfer

| Club | Distance range (yards) | Club | Distance range |
|---|---|---|---|
| 1 wood (driver) | 225-260 | 8 iron | 125-135 |
| 3 wood | 205-225 | 9 iron | 115-125 |
| 19° hybrid | 185-205 | Pitch wedge | 105-115 |
| 22° hybrid | 175-185 | Gap wedge | 95-105 |
| 5 iron | 155-165 | Sand wedge | 85-95 |
| 6 iron | 145-155 | Lob wedge | 75-85 |
| 7 iron | 135-145 | Putter | On the green |

As can be seen in Table 2, this set has a problematic gap for shots that must travel 165 to 175 yards. Table 3 shows another exemplary set that a golfer may employ.

TABLE 3

Distance range for reliable shots by club for a hypothetical golfer

| Club | Distance range (yards) | Club | Distance range |
|---|---|---|---|
| 1 wood (driver) | 225-260 | 8 iron | 125-135 |
| 3 wood | 205-225 | 9 iron | 115-125 |
| 5 wood | 185-205 | Pitch wedge | 105-115 |
| 25° hybrid | 165-175 | Gap wedge | 95-105 |
| 5 iron | 155-165 | Sand wedge | 85-95 |
| 6 iron | 145-155 | Lob wedge | 75-85 |
| 7 iron | 135-145 | Putter | On the green |

The set shown in Table 3 is plagued by a gap at 175 to 185 yards.

Thus, for many golfers, a set of clubs inherently defines a gap in the distances that their shots can cover. This gap has been described as the 'distance gap'. The persistence of the distance gap problem is evidenced by the tips that golfers exchange on the course, "Choke up on the handle of your 5 wood to take 5 yards off!" or, "Strengthen your grip on your 4 iron to add 5 yards."

SUMMARY

The invention provides a set of golf clubs in which at least one of the clubs is adjustable so that it can provide a golfer with reliable shots over a broad range, or over two ranges, of distance. An adjustable club may include a mechanism for adjusting the loft between at least a first and a second effective loft setting. The invention exploits the dimensions of a contoured sole that prevent unintended or undesired changes in face angle when a golfer switches between a first and a second loft setting. The contoured sole generally presents a stabilizing element towards the ground so that, when the club is held at address resting on the ground, the stabilizing element provides the point of contact with the ground. Clubs without such a stabilizing element flop between two different face angles when they are switched between two different lofts, making them unreliable for shots covering the full range of distances potentially associated with the multiple loft settings. Since an adjustable club of the invention does not flop between undesired face angles when the loft is adjusted, the club will be reliable for shots covering the full range of distances associated with multiple loft settings. Thus, an adjustable club can be included in a golfer's golf bag, the adjustable club having two (or more) effective loft settings, and that club can play double-duty in terms of the ranges of shot distances it is reliably useful for. In this way, the golfer's bag can contain fourteen clubs that cover all desired ranges between the putter and the driver.

In certain aspects, the invention provides a set of golf clubs, each having an extended shaft with a club head and a grip on opposing ends. At least one club of the set is an adjustable club in that it has an adjustment mechanism operable to provide two or more effective loft settings. Further, the face angle is stabilized by a stabilizing mechanism that gives the club the same face angle while having any of the two or more effective loft settings. The stabilizing mechanism can be, for example, a pad protruding from a sole of the club by a height H, having a maximum length L, a maximum width W, and a setback S from a front-most point on the club face the club is at address, wherein S is more than about 1 mm, L is more than about 1 mm, W is more than about 1 mm, and H is more than about 0.1 mm. In certain embodiments, H is between about 0.3 mm and about 2 mm, and in some embodiment S is between about 1 cm and about 3 cm, L is between about 2 cm and about 13 cm, W is between about 1 mm and about 3 cm, and H is between about 0.5 mm and about 1.2 mm. When the adjustable club is held at address in any of the two or more effective loft settings, the club head makes contact with the ground only within the stabilizing element. A number of different clubs within a set—i.e., drivers, woods, hybrids, and irons, can be adjustable and stabilized in this way.

In certain aspects, the invention provides a set with an adjustable club that includes a face, a sole, a crown, and a hosel, such that when the club is at address and resting on horizontal ground: a fore plane intersects the ground along a line substantially parallel to the face and a distance S from the front of the club—the fore plane being tangent to the sole and defining an angle of X degrees with the ground; a back plane intersects the ground along a second line parallel to the line and a distances (S+W) from the front of the club—the back plane being tangent to the sole and defining an angle of Y degrees with the ground; and the sole makes contact with the ground between the first and second line, and X+Y is between about 0.01° and about 40°. The setback distance S can be between about 5 mm and about 70 mm. The width W can be between about 0.1 mm and about 45 mm. In certain embodiments, X+Y is larger than the difference in lofts of settings of an adjustable loft club (e.g., between about 5° and about) 25°.

In certain embodiments, the adjustable club is configured to be connected to a shaft in a first configuration giving a first loft setting and a second configuration giving a second loft setting. Due to the shape of the sole, the adjustable club tends to balance with a certain face angle when held at address in the first loft setting resting on a horizontal planar surface, and tends to balance with the same certain face angle when held at address in the second loft setting resting on a horizontal planar surface.

In some embodiments, the first loft is between about 4° and about 23° and the second loft is between about 11° and about 25°, such that if the club is held at address in the first configuration, it balances with a neutral face angle and if the club is held at address in the second configuration, it balances with a neutral face angle. In some embodiments, X+Y is between about 2.5° and about 8°, S is between about 1 mm and about 5 cm, and W is between about 6 mm and about 15 mm.

Accordingly, the set may include a number N of clubs configured to provide a number N+1 of distinct loft angles, each of the distinct loft angles being at least 1° different from any other.

In certain aspects, the invention provides a method of providing a set of golf clubs, the method including receiving information identifying a golfer, a first club with a first loft and first hitting range, and a second club with a second loft and second hitting range, the hitting ranges defining distances associated with the ability of the golfer to make reliable shots with the associated club. With this information, one identifies a distance gap comprising a range of distances between the first and the second hitting range and determines a third loft intermediate to the first and second loft. Then, one may select from a list an adjustable club with an adjustment mechanism operable to confer on the adjustable club the first loft or the third loft and provide a set comprising the second club and the adjustable club. The method may be implemented through the use of a computer, either within a store or other facility or over the Internet. Thus in some embodiments, the method includes saving the information to a tangible, non-transitory memory operably coupled to a processor in a computer apparatus and using the processor in the identifying, determining, and selecting steps. In certain embodiments, the information is received over an Internet connection after having been input by a person using a web browser and the set is provided in the form of a list of clubs, the list being delivered electronically over the Internet connection to the web browser. By these means, a firm may offer to sell the adjustable club to the golfer and receiving an acceptance of the offer from the golfer. Due to the fact that an adjustable club of the invention allows one club head form-factor to provide a variety of lots, and thus an inventory tracking system requires fewer entries and tables for a full product line, a computer-implemented system and method of providing a club set is conducive to providing customized clubs (i.e., using the now "freed up" SKUs of the inventory tracking system to flexibly store custom order information pertaining to parts, colors, trim levels, etc.). Accordingly, in some embodiments, the method further comprises receiving a selection from the golfer of an option for a customizable feature of the adjustable club and selling the customized adjusted club to the golfer.

DETAILED DESCRIPTION

Figure 1:
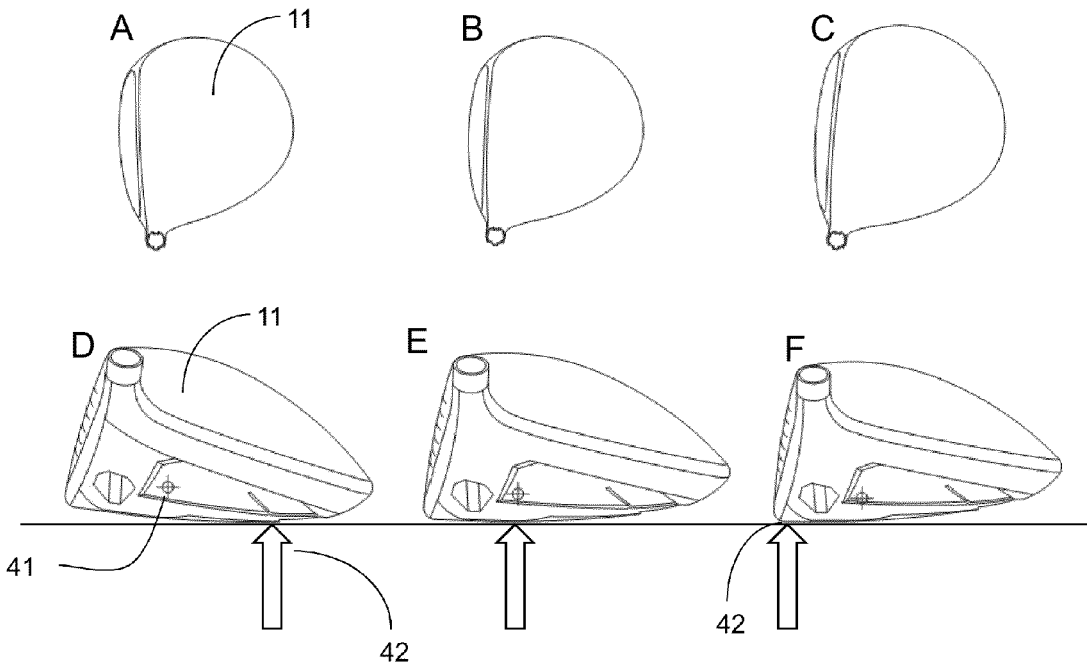
FIG. 1 PRIOR ART
FIG. 1 shows a prior art golf club head.

The invention generally provides a set of golf clubs, each having a shaft with a club head and a grip on opposing ends. At least one club of the set is an adjustable club in that it has an adjustment mechanism operable to provide two or more effective loft settings. The adjustable club may include a stabilizing mechanism that gives the club the same face angle while having any of the two or more effective loft settings. By these means, the club can play (at least) "double duty" in a golfer's set. This way, a golfer can get clubs suited for 15 different types of shots out of 14 individual clubs. Table 4 lists an exemplary club set made to include an adjustable hybrid.

TABLE 4

Exemplary club set including adjustable hybrid.

| Club | Distance range (yards) | Club | Distance range |
|---|---|---|---|
| 1 wood (driver) | 225-260 | 8 iron | 125-135 |
| 3 wood | 205-225 | 9 iron | 115-125 |
| 19°\|22° adj hybrid | 175-185, 185-205 | Pitch wedge | 105-115 |
| 25° hybrid | 165-175 | Gap wedge | 95-105 |
| 5 iron | 155-165 | Sand wedge | 85-95 |
| 6 iron | 145-155 | Lob wedge | 75-85 |
| 7 iron | 135-145 | Putter | On the green |

While generally presented here in terms of the longer-range clubs (e.g., woods, hybrids, and irons), any club can be made adjustable. Further, the tables presented herein are illustrative of ranges that some one hypothetical golfer may get out of their personal set of clubs, and it will be appreciated that the invention provides the operative idea of a set of clubs for any golfer, whatever range values obtain for that golfer for their clubs personally. Thus, the specific ranges shown herein are not limiting and merely illustrate the operation of the inventive concept.

For example, some golfer out there may derive great satisfaction from their 3 wood and their 5 wood. This golfer may normally forgo the use of a 3 iron, and thus have a problematic distance gap between their 4 iron and their 5 wood. Making use of an adjustable club of the invention, this hypothetical golfer may solve this problem by equipping themselves with an adjustable hybrid having a 25° loft angle and a 22° loft angle, and leaving behind both their 3 iron and their 4 iron. This golfer's golf bag would then include the clubs listed in Table 5.

TABLE 5

Contents of golf bag of golfer using inventive club set with 3 wood and 5 wood.

| Club | Distance range (yards) | Club | Distance range |
|---|---|---|---|
| 1 wood (driver) | 225-260 | 8 iron | 125-135 |
| 3 wood | 205-225 | 9 iron | 115-125 |
| 5 wood | 185-205 | Pitch wedge | 105-115 |
| 25°\|22° adj hybrid | 165-175, 175-185 | Gap wedge | 95-105 |
| 5 iron | 155-165 | Sand wedge | 85-95 |
| 6 iron | 145-155 | Lob wedge | 75-85 |
| 7 iron | 135-145 | Putter | On the green |

To contrast the example given with respect to Table 5, some other golfer may personally prefer to not use hybrids. This other golfer has traditionally gone to the course without a 5 wood, instead just carrying a 3 wood, a 3 iron, a 4 iron, and so on. This golfer may now obtain an adjustable wood according to the invention, the adjustable wood providing the role of a 3 wood and a 5 wood. This golfer's set is represented as now listed in table 6.

TABLE 6

Golf club set of invention for golfer who disfavors hybrids.

| Club | Distance range (yards) | Club | Distance range |
|---|---|---|---|
| 1 wood (driver) | 225-260 | 8 iron | 125-135 |
| 3\|5 adj wood | 185-205, 205-225 | 9 iron | 115-125 |
| 3 iron | 175-185 | Pitch wedge | 105-115 |
| 4 iron | 165-175 | Gap wedge | 95-105 |
| 5 iron | 155-165 | Sand wedge | 85-95 |
| 6 iron | 145-155 | Lob wedge | 75-85 |
| 7 iron | 135-145 | Putter | On the green |

The ability of a club head of the invention to provide two or more reliable ranges for a given golfer relates to the provision of a stabilizing element, generally protruding from the sole of a club. The invention proceeds from the insight that prior art adjustable clubs provided poor playability due to poor control over face angle when a loft angle was adjusted.

FIG. 1, panels D-F, show a prior art club head 11 positioned to produce different loft angles. In particular, panels D and A show prior art club head 11 having an 11.5° loft angle; panels E and B show prior art club head 11 having a 10° loft angle; and panels F and C show prior art club head 11 having an 8.5° loft angle. The invention mitigates the positional change of the sole relative to a club balance point 41 in different loft angles when club head 11 has different face angles (e.g., closed in panel A, neutral in panel B, and open in panel C).

Figure 2:
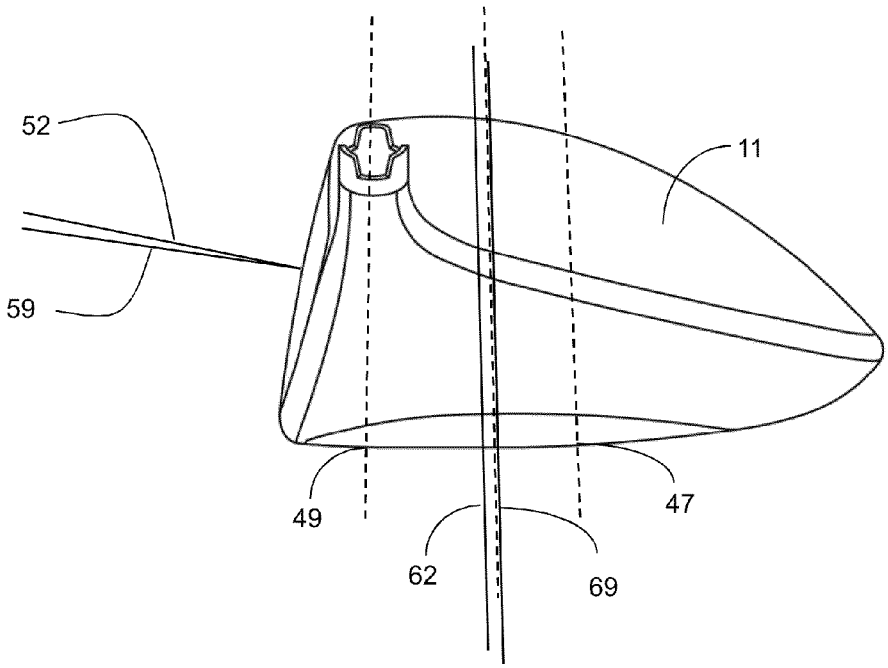
FIG. 2 PRIOR ART
FIG. 2 shows a prior art golf club head.

FIG. 2 shows prior art golf club head 11. FIG. 2 includes high loft indicator 52 and low loft indicator 59 as well as high loft contact indicator 47 and low loft contact indicator 49. FIG. 2 further shows high loft balance line 62 and low loft balance line 69 of prior art club head 11. As shown in FIG. 2, if prior art club head 11 is set with a high loft setting, it has a balance line 62 substantially fore (e.g., between about 1 and about 5 cm) of corresponding contact point 47. If prior art club head 11 is set with a low loft setting, it has a balance line 69 substantially aft of that corresponding contact point 49.

Figure 3:
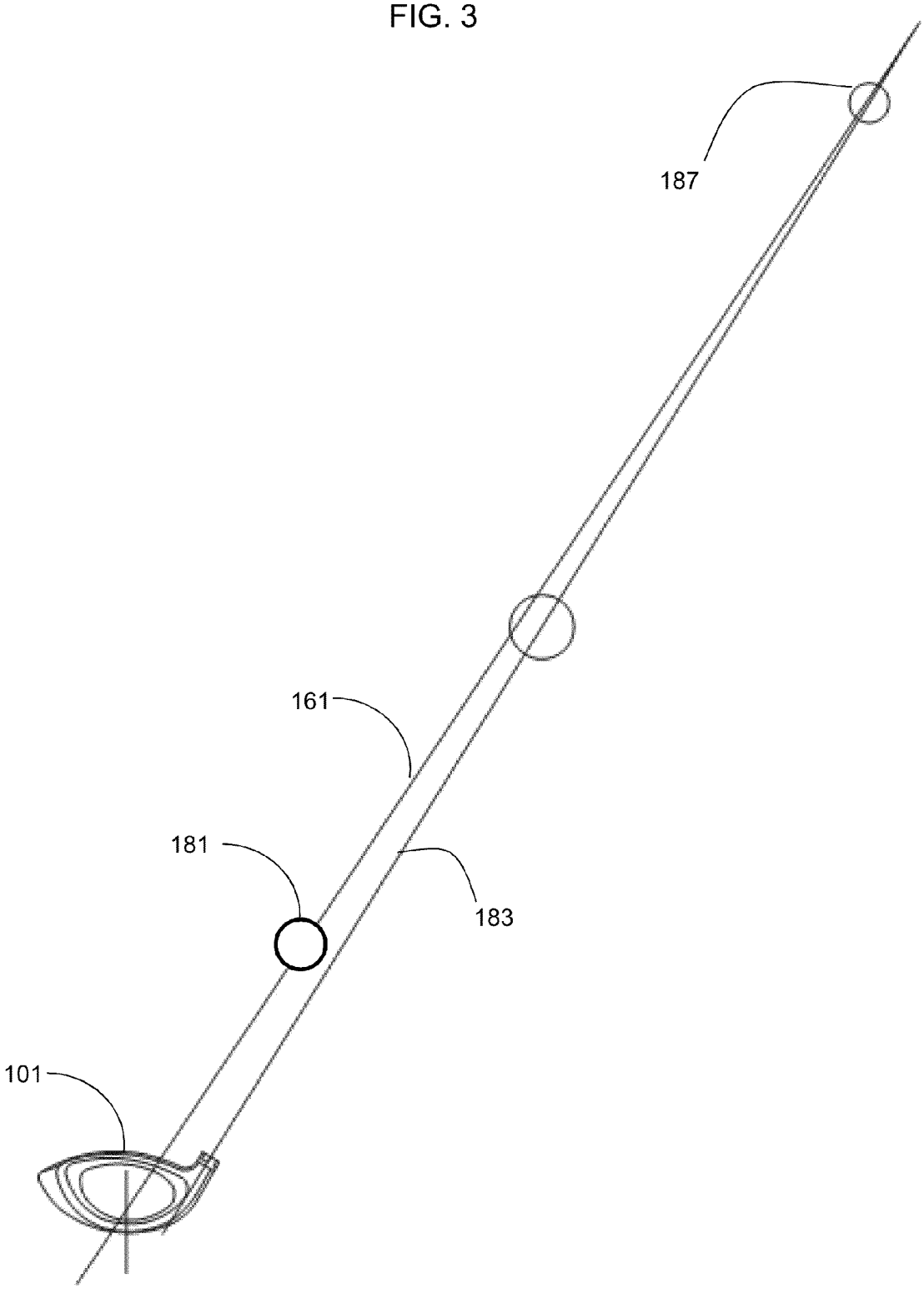
FIG. 3 is a front view of a golf club according to certain embodiments of the invention.

FIG. 3 is a front view of a golf club head at address according to certain embodiments of the invention showing balance line 161 passing through grip point 187 and club center of gravity 181. Shaft axis 183 passes through the center of a hosel of club head 101.

When a club is at address resting on a surface, grip point 187 and contact point 42 together define an axis around which motion of the golf club is relatively unrestrained. If balance line 161 intersects the sole behind the contact point, the club will rock open. If balance line 161 intersects the sole in front of the contact point, the club will rock closed.

Thus, the invention provides club head 101 having a sole with a contour or feature such that, if the club is held at address in a variety of orientations, then the contact point is within a controlled, limited distance from the point at which the balance line intersects the sole. Accordingly, the club can be held at address, yet in two different orientations at different times. For example, a first address position can be offset from a second address position by a slight tilt (e.g., either in a heel-toe direction, a fore-aft direction, or a combination thereof) and the contact point will be within the contour or feature in each address positions. In some embodiments, the sole is configured such that, when a golf club including the club head is held at address in either of a first or second position, the club head makes contact with a surface only within a stabilizing element as described herein.

Thus the invention allows a club to be held in different address positions (e.g., as a player learns or experiments, due to ground inconsistencies, as one club is used by players of different height) and obtain a consistent, predictable club head orientation. Due to the fact that the club head makes contact with the ground within a controlled region below the club balance point, the club will not "rock" into unintended orientations when held at address resting on a surface.

In certain embodiments, the invention provides club head 101 having a sole with a contour or feature such that, if the club head is set in a variety of loft settings, then the contact point is within a controlled, limited distance from the point at which the balance line intersects the sole. Club head 101 can have an adjustable loft capable of being set in at least a first and second position. With the loft set in either of the first or second position, the club head can rest on the feature in one of at least a first and second disposition allowing a player to grip the club with a comfortable, relaxed grip in each position and with the face angle maintained constant between each position.

The invention allows a player to adjust a loft setting, hold the club at address resting on a surface, and obtain a consistent, predictable face angle. This benefit gives a player a reliable reference point when setting up a shot in that the player can rest the club head on a surface and see the loft setting and the face angle (while the player holds the club with a comfortable, relaxed grip). The player can then grip the club and pick it up to make a shot, thereby obtaining the same relative face angle for every shot.

Figure 4:
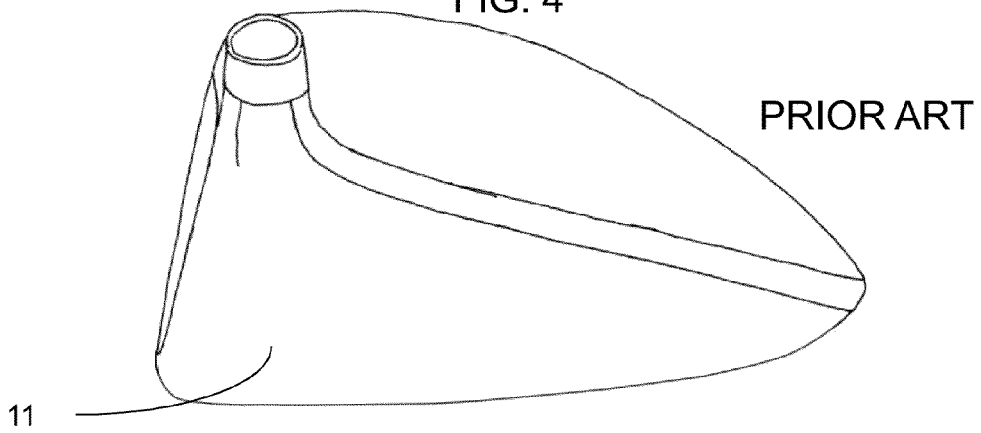
FIG. 4 shows a prior art golf club head.
Figure 5:
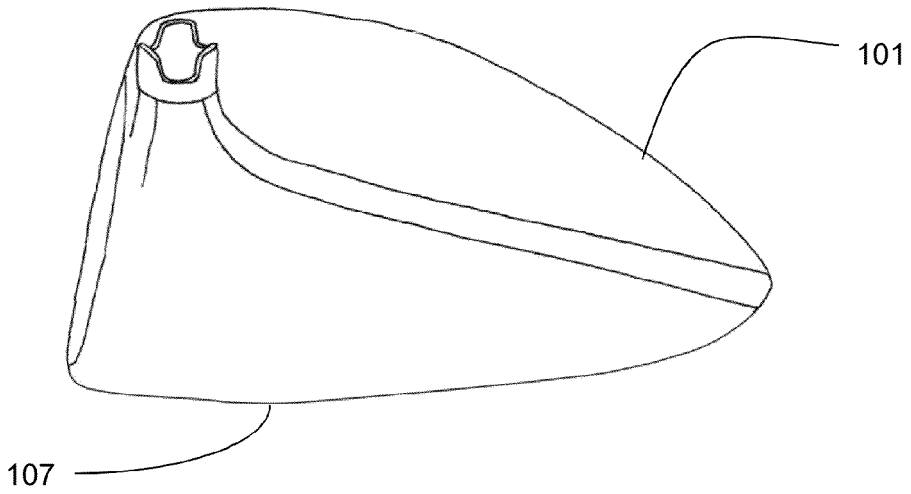
FIG. 5 is a side view of a golf club head according to certain embodiments of the invention.
Figure 6:
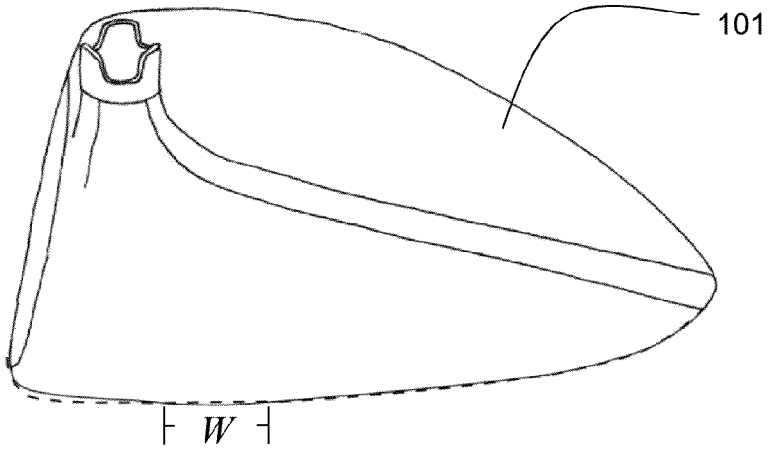
FIG. 6 shows the view of FIG. 5 with a prior art sole superimposed (dashed line).
Figure 7:
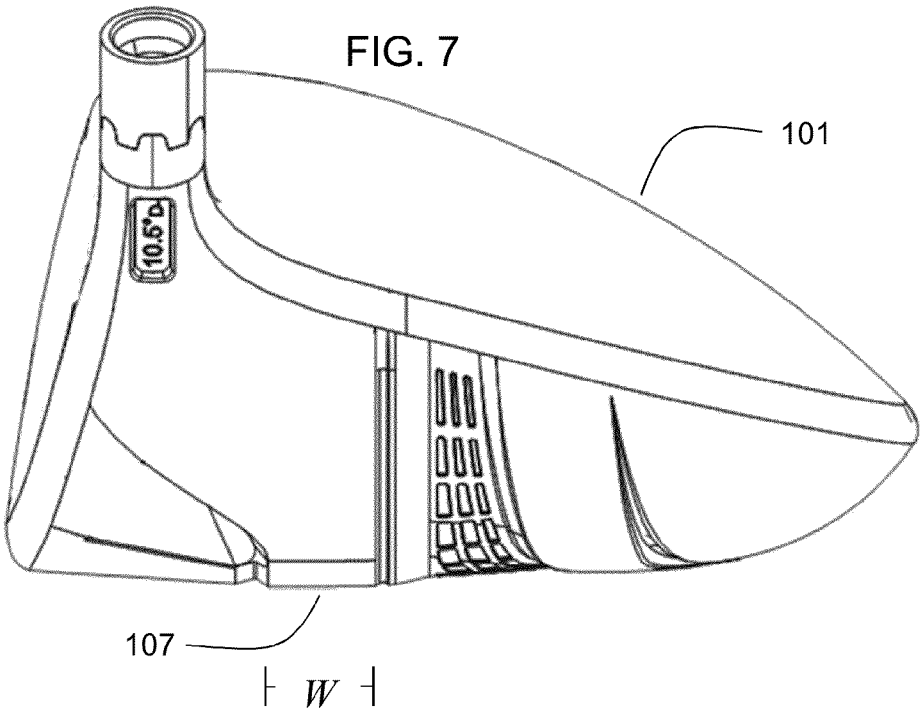
FIG. 7 is a side view of a golf club head according to certain embodiments of the invention.
Figure 8:
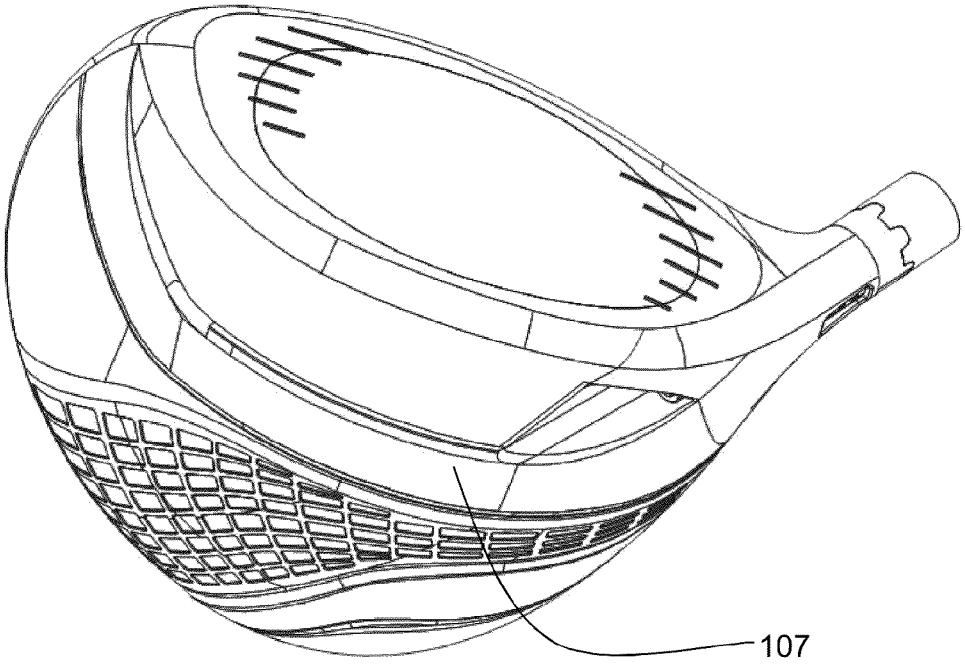
FIG. 8 is a bottom perspective view of a golf club head according to certain embodiments of the invention.
Figure 9:
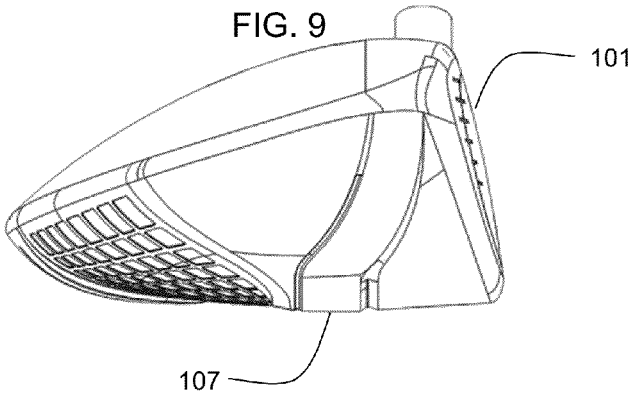
FIG. 9 is a side view of a golf club head according to certain embodiments of the invention.

FIG. 4 shows a prior art golf club head and FIG. 5 is a side view of a golf club head according to certain embodiments of the invention. FIG. 6 shows the view of FIG. 5 with a prior art sole superimposed (dashed line). As shown in FIG. 5, a golf club according to the invention generally has an area of relief on the sole providing a lower-most region 107 of the sole such that, if the club head is set in any of a range of loft angle settings, the contact point will be within region 107, and the region has a limited width W in the fore-aft direction. In general, the width W of the region in the fore-aft direction will be less than about 50 mm, for example, less than about 25 mm. In some embodiments, the contact points associated with various loft settings will be within less than about 20 or about 15 mm of each other in a fore-aft direction.

Figure 10:
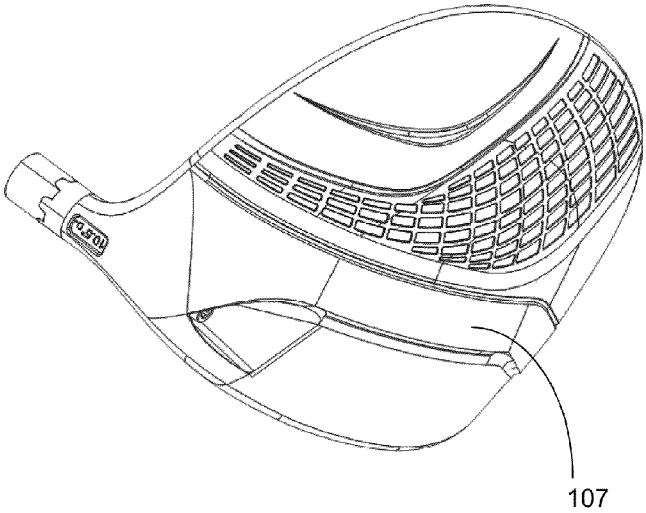
FIG. 10 is a bottom-rear perspective view of a golf club head according to certain embodiments of the invention.
Figure 11:
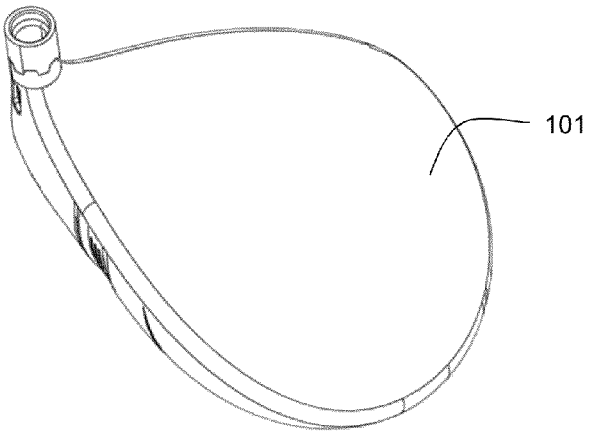
FIG. 11 is a top-rear perspective view of a golf club head according to certain embodiments of the invention.

FIGS. 7-11 show club heads of various embodiments of the invention. As presented herein throughout, no figure is limited to an embodiment illustrated by another figure. While a golf club head according to the invention can exhibit all the views shown in FIGS. 7-11, a head having a sole as shown in FIG. 10 need not have a crown as shown in FIG. 11, and so for any pair of figures herein. Except where otherwise indicated, any disclosed measurement or definition of a measurement may apply to any embodiment pictured or discussed herein.

Figure 12:
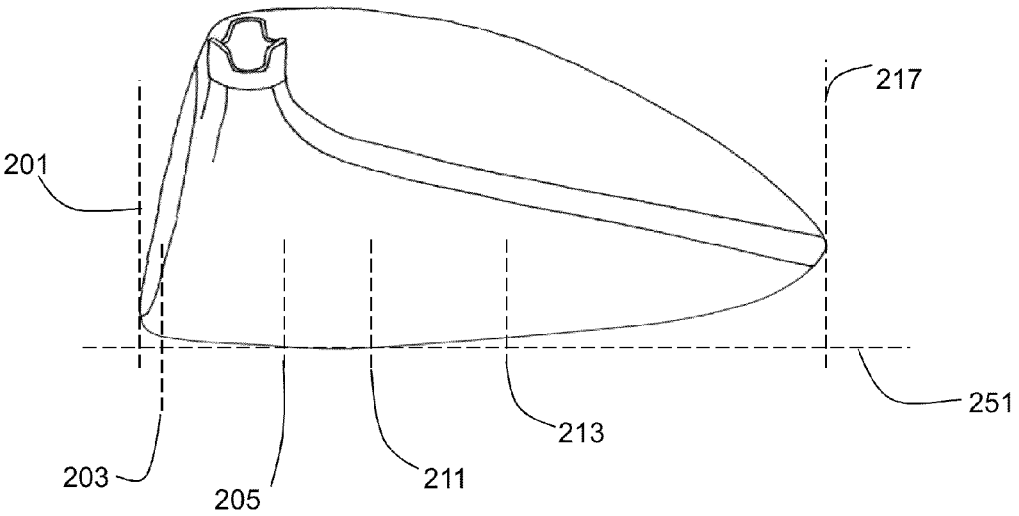
FIG. 12 is a side view of a golf club head according to certain embodiments of the invention showing boundaries of regions of a sole.

As shown in FIGS. 7-11, club head 101 has a region 107 that is generally the lowest area of the sole when the club head is at address. Region 107 can be discussed with reference to boundaries. FIG. 12 is a side view of a golf club head according to certain embodiments of the invention showing boundaries of regions of a sole.

As shown in FIG. 12, when club head 101 is at address on a plane 251, the foremost point of club head 101 defines a vertical plane at the front 201 of club head 101. Face-sole boundary 203 can be used to mark the fore edge of the sole. Region 107 begins at fore boundary 205. Region 107 is bounded in the aft direction by aft boundary 211.

For the purposes of describing region 107 according to the discussion below, a rear sole boundary 213 is defined as a plane a distance E back from aft boundary 211 that is the same as a distance E between fore boundary 205 and face-sole boundary 203. The rear-most point of club head 101 defines a vertical plane at the back 217 of the head, parallel to the plane at the front 201 of the head, and both orthogonal to plane 251.

Figure 13:
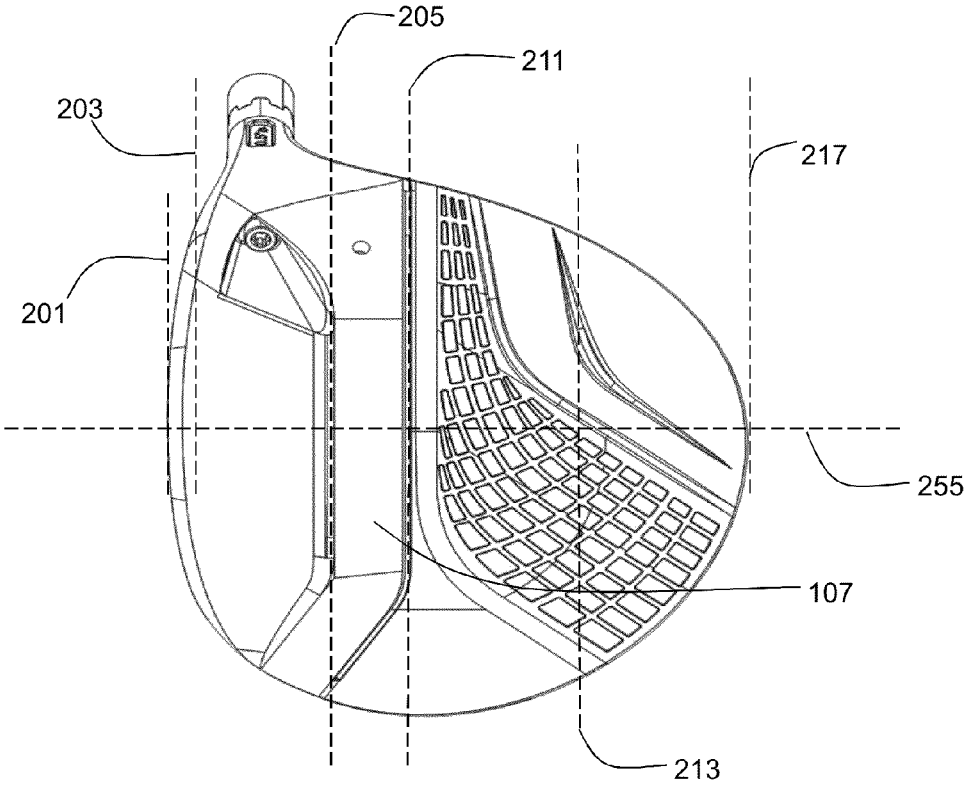
FIG. 13 is a bottom view of a golf club head according to certain embodiments of the invention showing boundaries of regions of a sole.

FIG. 13 is a bottom view of a golf club head according to certain embodiments of the invention showing boundary regions of a sole. Fore boundary 205 and aft boundary 211 bound region 107 in the fore-aft direction.

Generally a club head 101 may have a transition between a face and a sole having length T (e.g., a rounded region, angled region, stepped region, or sharp region). Face-sole boundary 203 marks an edge between that transition and the substantially downward-facing sole. Rear sole boundary 213 is defined as the same distance E from aft boundary 211 as the distance E between fore boundary 205 and face-sole boundary 203. Fore-aft line 255, perpendicular to front plane 201 and lying along ground plane 251 through a club contact point 42 can be used to measure these distances.

Figure 14:
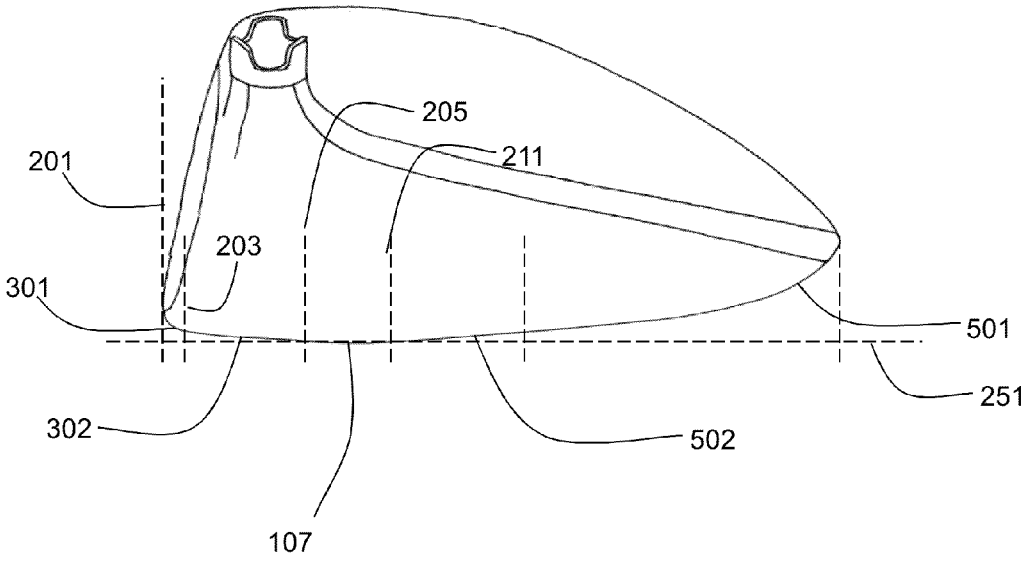
FIG. 14 is a side view of a golf club head according to certain embodiments of the invention showing regions of a sole.
Figure 15:
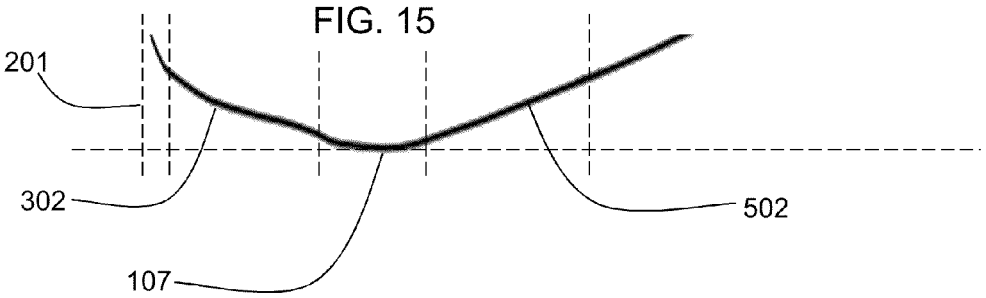
FIG. 15 is a side view of a golf club head according to certain embodiments of the invention, exaggerated in the vertical direction and showing regions of a sole.
Figure 16:
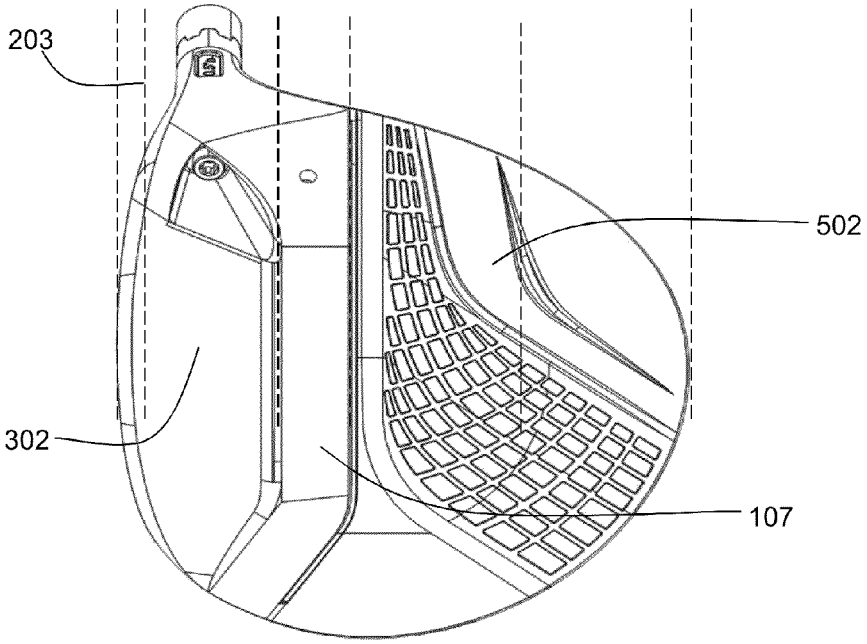
FIG. 16 is a bottom view of a golf club head according to certain embodiments of the invention showing regions of a sole.

FIGS. 14-16 illustrate regions of a sole defined by these boundaries. Particular reference is made to fore sole 302, region 107, and aft sole 502. Fore sole 302 is the area between fore boundary 205 and face-sole boundary 203. Region 107 is the area between fore boundary 205 and aft boundary 211. Aft sole 502 is the region between aft boundary 211 and rear boundary 213. By definition, aft sole 502 has the same extent E in the fore-aft direction as fore sole 302.

FIG. 15 shows a detail view of the sole illustrated in FIG. 14, greatly exaggerated in the vertical direction. As can be seen in FIG. 15, region 107 presents the lowest area of the sole when the club head is at address. Further as can be seen in FIG. 15, club head 101 of the invention makes contact with ground plane 251 within region 107 when at address.

Figure 17:
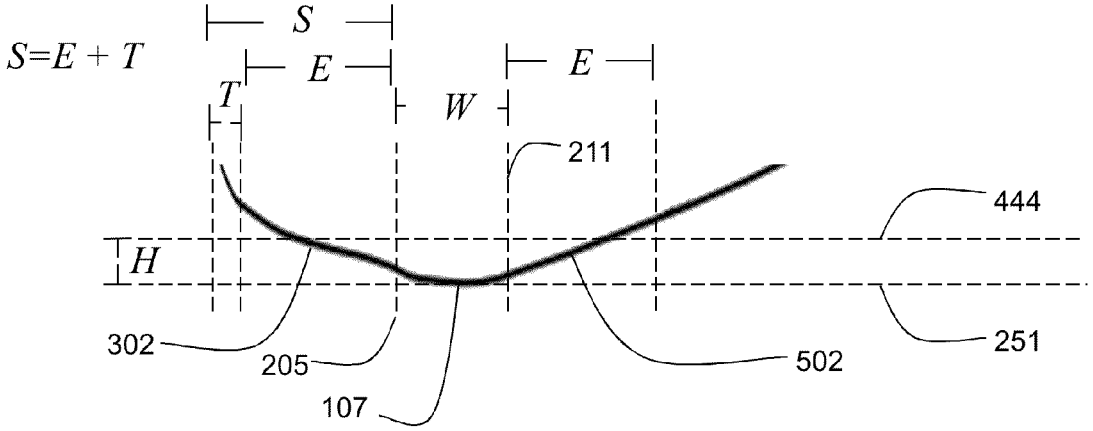
FIG. 17 is a side view of a golf club head according to certain embodiments of the invention, exaggerated in the vertical direction and showing measurements of a feature of the invention.

Turning now to FIG. 17, which presents the same detail view as presented in FIG. 15, dimensions of region 107 can be defined.

Figure 18:
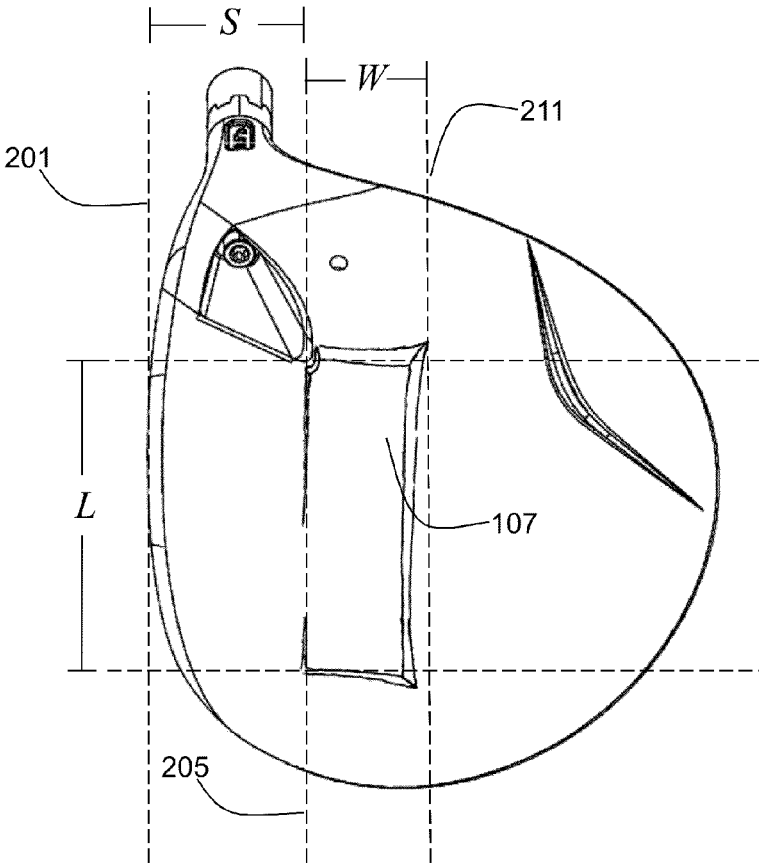
FIG. 18 is a bottom view of a golf club head according to certain embodiments of the invention showing measurements of a feature of the invention.

As shown in FIGS. 17 and 18, a distance between fore boundary 205 and aft boundary 211 measured along fore-aft line 255 can define a width W of region 107. A distance between front 201 and fore boundary 205 measured along fore-aft line 255 can define a setback S of region 107.

A length or extent E of fore sole 302 can be defined as a setback S of region 107 minus a length T of the face-sole transition. Alternatively, an extent E of fore sole 302 can be defined as an arbitrary measurement forward from fore boundary 205. Alternatively, in some embodiments, an extent E of fore sole 302 is equal to a width W of region 107. An extent E of aft sole 502 is, by definition, equal to an extent E of fore sole 302.

When club head 101 is at address, the average distance of fore sole 302 and aft sole 502 along fore-aft line 255 from ground plane 251 is shown by average sole height line 444. The vertical distance between height line 444 and ground plane 251 can define a height H of region 107.

Region 107 can be described with reference to a length L measured in a heel-toe direction.

Thus, according to the foregoing discussion, club head 101 according to embodiments of the invention generally has a protruding region 107 on the sole having a width W, a height H, and a length L, and being spaced away from the face of the club by a setback S. FIG. 18 shows region 107 having a generally rectangular shape in plan-view (i.e., map view). Region 107 need not have a rectangular shape in plan view and can be round, oblong, irregular, oval, curved, or any other shape. Generally, region 107 can be described with reference to width W, height H, and length L as maximum width W, maximum height H, and maximum length L, and setback S as minimum setback S.

Generally, S is greater than about 0.5 cm, L is more than about 0.5 cm, W is more than about 0.5 mm, and H is more than about 0.1 mm. In certain embodiments, S is between about 2.5 cm and about 3.5 cm; L is between about 2.5 cm and about 12 cm; W is between about 3 mm and about 25 mm; and H is between about 0.3 mm and about 2 mm. For example, S can be between about 2.8 cm and about 3.3 cm; L can be greater than about 1 cm; W can be between about 9 mm and about 20 mm; and H can be between about 0.1 mm and about 3 mm. Any combination of measurements disclosed herein is within the scope of the invention. For example, in certain embodiments, S is more than about 2.5 cm; L is greater than about 1 cm; W is between about 9 mm and about 20 mm; and H is between about 0.3 mm and about 2 mm.

Golf club head 101 having region 107 according to embodiments of the invention exhibits desirable behaviors, particularly an adjustable loft that does not affect the face angle when the club is at address.

Figure 19:
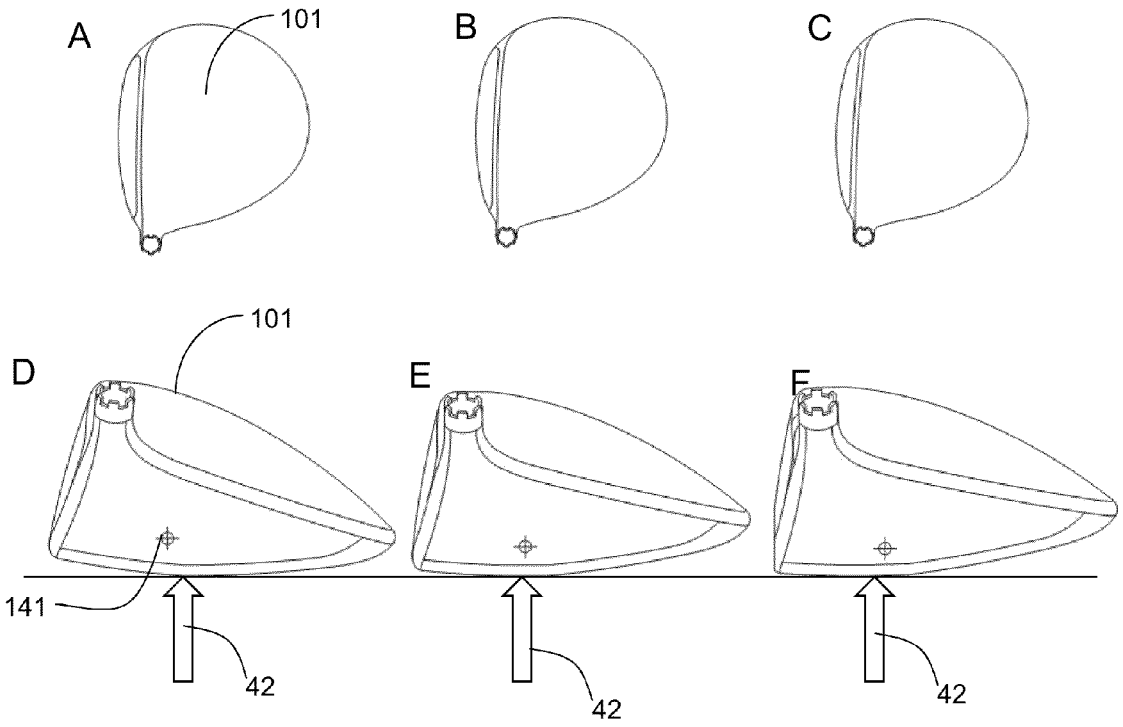
FIG. 19 illustrates properties of features of the invention.

As shown in FIG. 19, whether club head 101 has an 11.5° loft angle (panel D), a 10° loft angle (panel E), or an 8.5° loft angle (panel F), club head 101 exhibits a substantially neutral face angle. Further, this relationship holds for any face angle. If club head 101 is set to have an open face angle, for example, and the loft is adjusted, club head 101 will still exhibit an open face angle (and so for a closed face angle).

Figure 20:
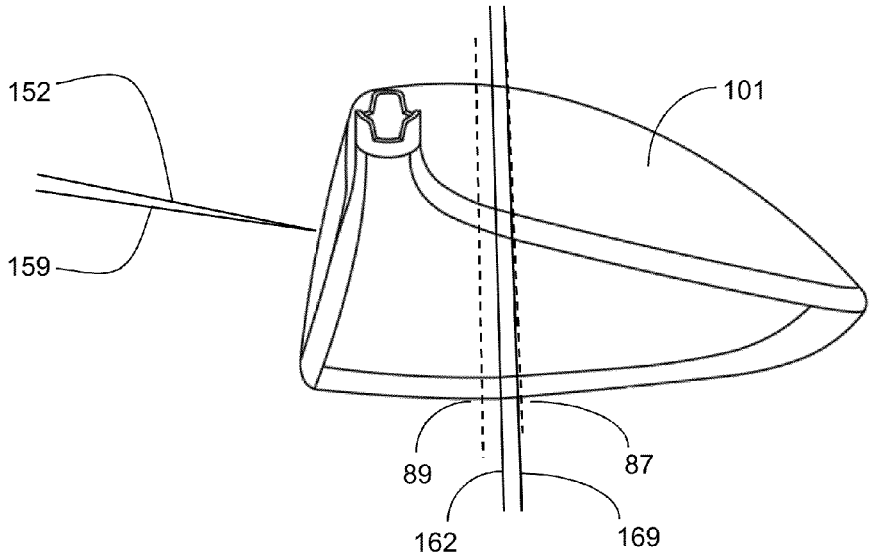
FIG. 20 illustrates properties of features of the invention.

Without being bound by any theory of operation, FIGS. 19 and 20 illustrate properties of club head 101. When set with high loft 152, contact point 87 is close to balance line 162. When set with low loft 159, contact point 89 is relatively close to balance line 169. In each loft setting, club head 101 makes contact with the ground through a portion of the material within region 107.

Figure 21:
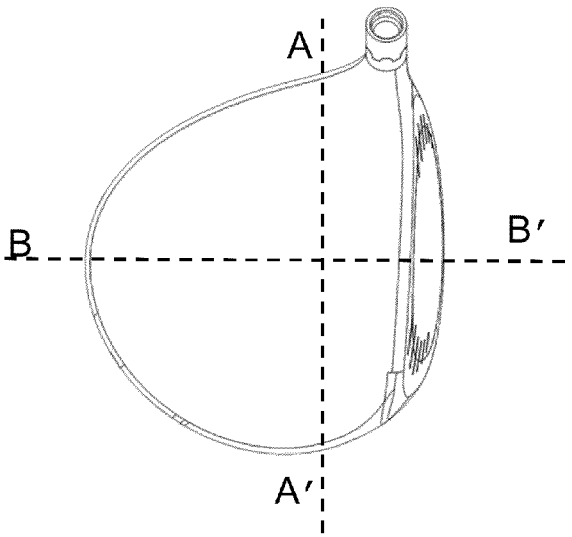
FIG. 21 is a top view of a golf club head according to certain embodiments of the invention.
Figure 22:
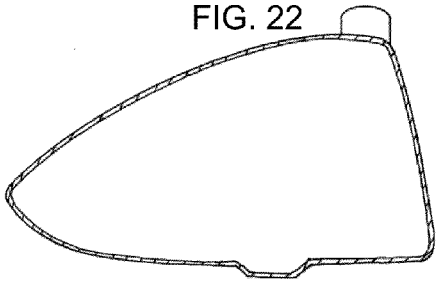
FIG. 22 is a cross-sectional view of a golf club head according to certain embodiments of the invention, taken along a line corresponding to line B-B' in FIG. 21.

FIG. 21 is a top view of club head 101. FIG. 22 is a cross-sectional view of a golf club head according to certain embodiments of the invention, taken along a line corresponding to line B-B' in FIG. 21. In some embodiments, club head 101 has a shape illustrated in FIGS. 22-33, however, FIGS. 22-33 can represent exaggerations of a shape of club head 101. In general, these figures illustrate a general morphology, and dimensions may be referred to independently of any figure.

Figure 23A:
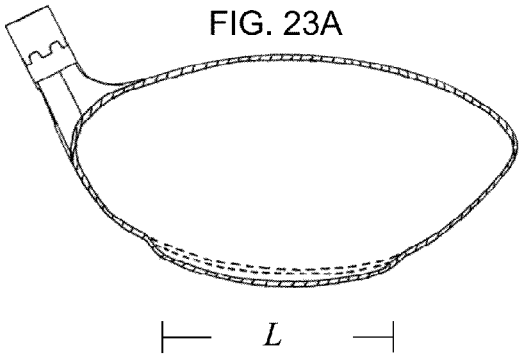
FIGS. 23A-B are each a cross-sectional view of a golf club head according to certain embodiments of the invention, taken along a line corresponding to line A-A' in FIG. 21.
Figure 23B:
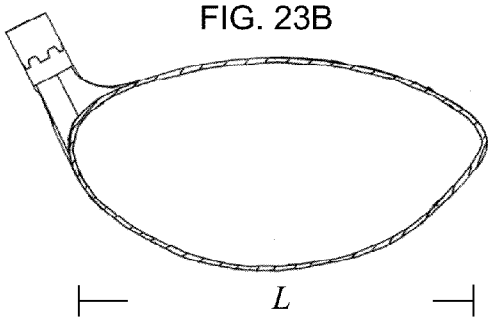
Figure 23C:
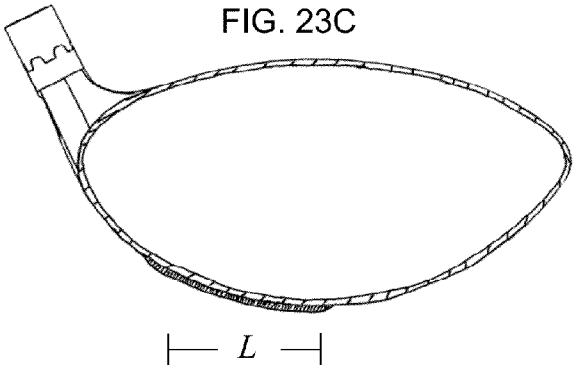

FIGS. 23A-B are each a cross-sectional views of a golf club head according to certain embodiments of the invention, taken along a line corresponding to line A-A' in FIG. 21. As shown in FIG. 23A, region 107 may protrude down from club head 101 such that it has a length L in the heel-toe direction between about 5 cm and about 9 cm. As shown in FIG. 23B, region 107 may smoothly span from the heel to the toe of club head 101, such that it has a length L between about 9 cm and about 13 cm. As shown in FIG. 23C, region 107 may have a length L between about 3 cm and about 5 cm. Moreover, as shown in FIG. 23C, region 107 may be off-center in a heel-toe dimension, in either direction or by any amount. In some embodiments, region 107 is centered, biased towards a heel, or biased towards a toe.

Figure 24:
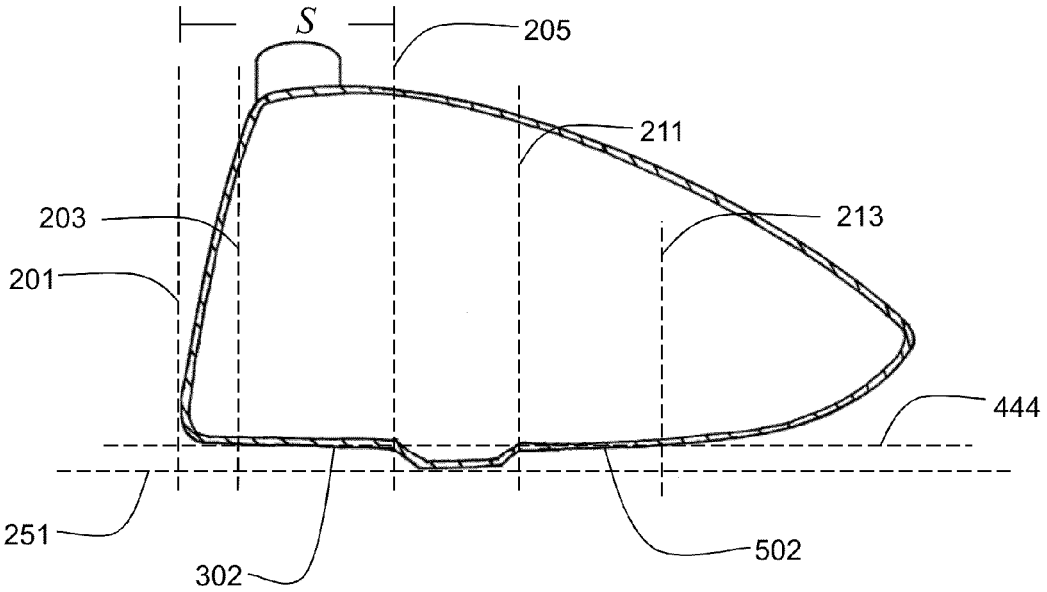
FIG. 24 is a cross-sectional view of a golf club head according to certain embodiments of the invention, taken along a line corresponding to line B-B' in FIG. 21.
Figure 25:
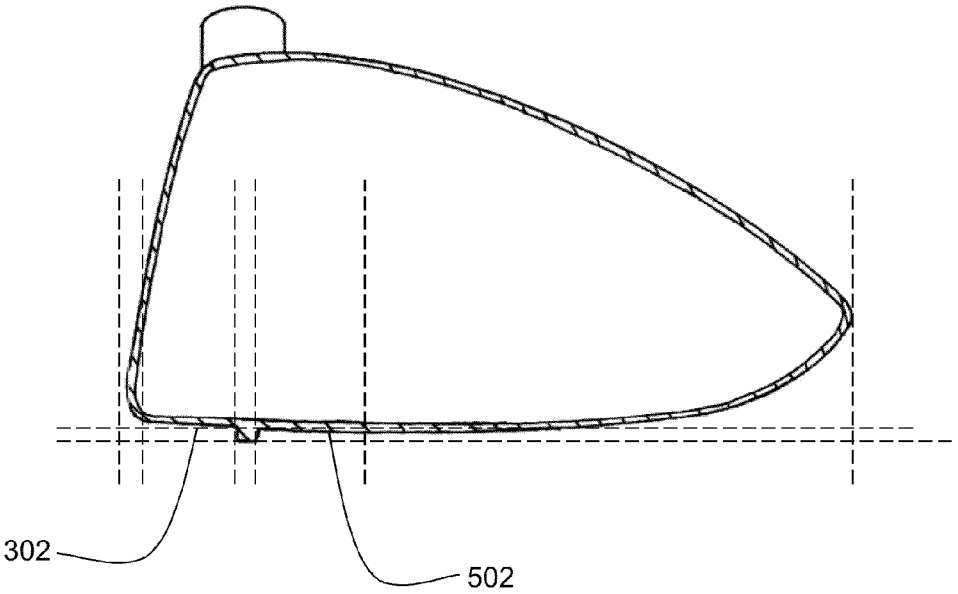
FIG. 25 is a cross-sectional view of a golf club head according to certain embodiments of the invention, taken along a line corresponding to line B-B' in FIG. 21.
Figure 26:
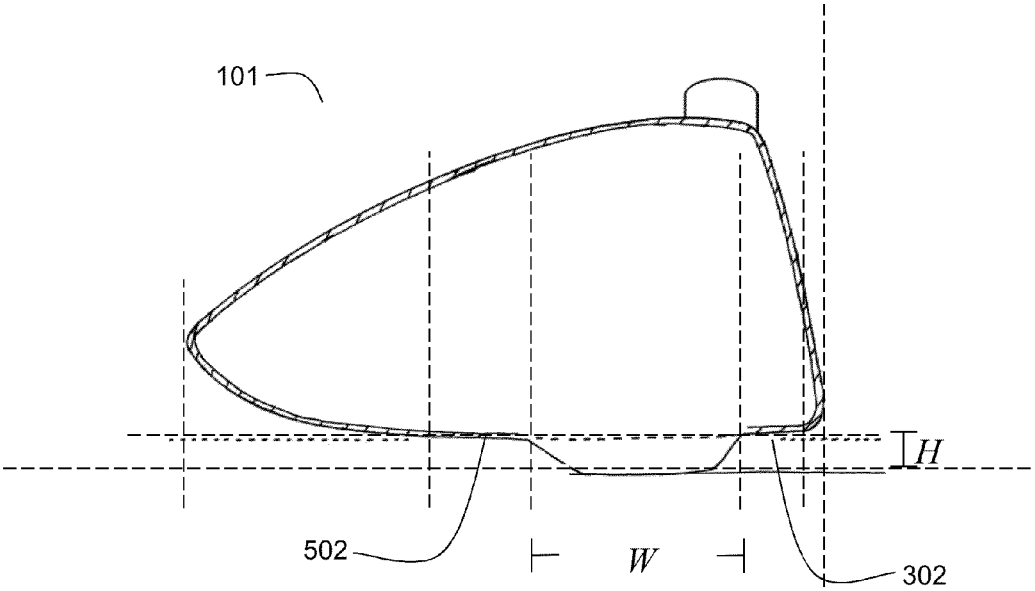
FIG. 26 is a cross-sectional view of a golf club head according to certain embodiments of the invention, taken along a line corresponding to line B-B' in FIG. 21.
Figure 27:
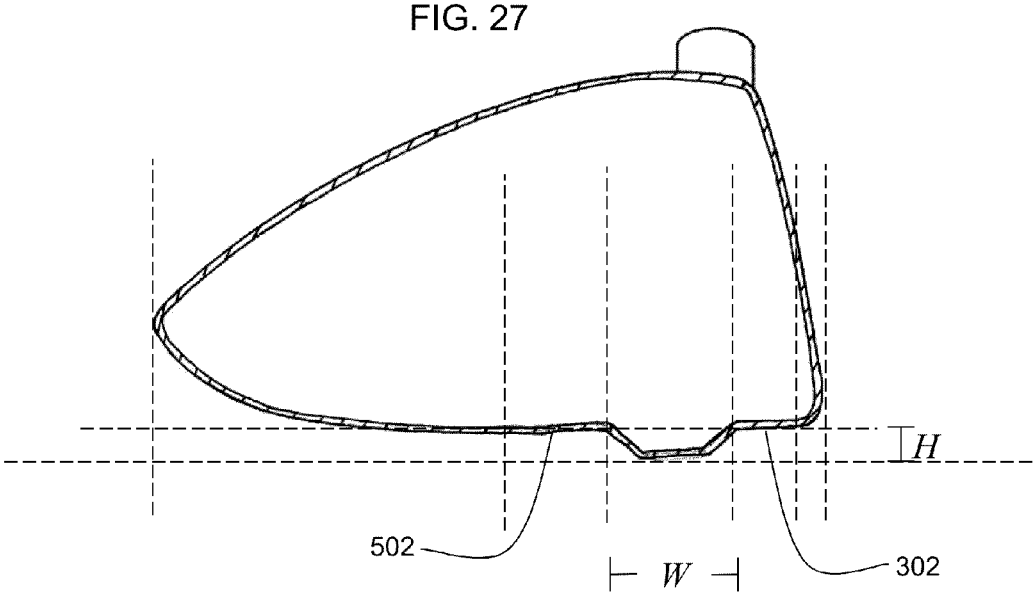
FIG. 27 is a cross-sectional view of a golf club head according to certain embodiments of the invention, taken along a line corresponding to line B-B' in FIG. 21.

FIGS. 24-27 are cross-sectional views according to certain embodiments of the invention, taken along a line corresponding to line B-B' in FIG. 21. As shown in FIG. 24, a setback S can be between about 3 cm and about 6 cm or a width W can be between about 0.5 cm and about 4 cm. As shown in FIG. 25, a setback S can be between about 1 cm and about 3 cm, or a width W can be between about 0.1 mm and about 9 mm. As shown in FIG. 26, a setback S can be between about 1 cm and about 3 cm, or a width W can be between about 0.5 cm and about 6 cm. As shown in FIG. 27, a setback S can be between about 0.5 cm and about 4 cm or a width W can be between about 0.5 cm and about 4 cm.

As shown in FIGS. 24-27, an extent E of fore sole 302 (by definition, equal to an extent E of aft sole 502) can be between about 0.3 cm and about 6 cm.

As discussed above, region 107 can be described with reference to length, width, height, and setback. Independently or additionally region 107 can be described according to other aspects of club head 101. Club head 101 will generally exhibit certain geometric properties as described herein.

Figure 28:
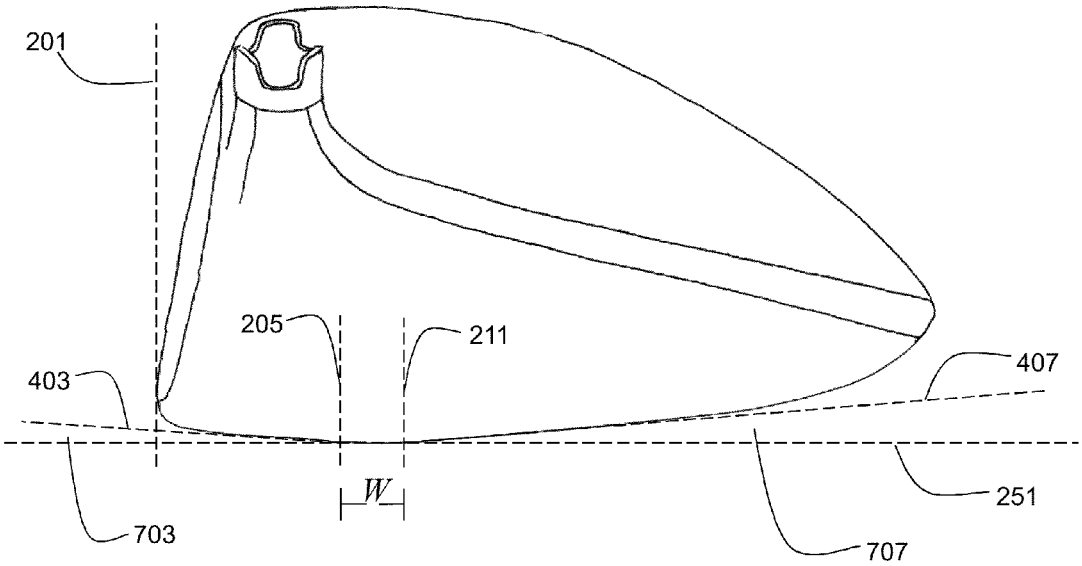
FIG. 28 is a side view of a golf club head according to certain embodiments of the invention.

FIG. 28 shows a side view of club head 101 according to certain embodiments of the invention at address. As shown in FIG. 28, region 107 is generally disposed between fore boundary 205 and aft boundary 211. As shown in FIG. 28, club head 101 has a loft between about 10° and about 11°.

Fore boundary 205 intersects ground plane 251 defining an intersection line. A front plane 403 intersects this line at a setback distance S from the front of the club, defining a fore angle 703 of X degrees with the ground. Front plane 403 is tangent to the sole.

Aft boundary 211 intersects ground plane 251 along a line. A back plane 407 intersects this line and is tangent to the sole. Back plane 407 defines a back angle 707 of Y degrees with ground plane 251.

When club head 101 is at address and resting on a plane 251, the sole makes contact with the surface within region 107 and X+Y is greater than 0°. In certain embodiments, X+Y is between about 0.01° and about 40°. Setback S and width W can each independently be any measurement. For example, setback S can be between about 5 mm and about 80 mm. Width W can be between about 1 mm and about 60 mm. Preferably, S is between about 20 mm and about 40 mm, e.g., between about 30 mm and about 35 mm, while W is between about 5 mm and about 30 mm, e.g., between about 5 mm and about 15 mm or between about 15 mm and about 25 mm. Preferably X+Y is between about 3° and about 23° (e.g., between about 5° and about 12°).

FIGS. 29-33 each show a cross-sectional view of a golf club head according to certain embodiments of the invention, taken along a line corresponding to line B-B' in FIG. 21. As shown in FIGS. 29-33, a region 107 can be provided on a club head such that a front plane 403 (tangent to the sole) meets ground plane 251 at fore boundary 205 to define a fore angle 703 of X degrees with ground plane 251. Front plane 403 is tangent to the sole. Similarly, back plane 407 (tangent to the sole) meets ground plane 251 at aft boundary 211 to define a back angle 707 of Y degrees with ground plane 251. When club head 101 is at address with a loft between about 10° and about 11°, each of X or Y may independently be between about 0.5° and about 8°, preferably between about 1° and about 8°. In certain embodiments, either of X or Y is between about 0.5° and about 5° (e.g., X between about 1.5° and about 5° and Y between about 0.5° and about 5°).

In a preferred embodiment, where club head 101 is part of a club having a loft that is adjustable from a minimum loft P to a maximum loft Q, the following will hold:

$$(X+Y)\geq(Q-P) \tag{1}$$

As shown in equation 1, fore angle 703 and back angle 707 together preferably define a range equal to or greater than the total range of adjustable loft for club head 101. Accordingly, in certain embodiments, a golf club is provided in which the loft can be set at two or more effective settings including a setting at about 8.5° loft and a setting at about 11.5° (range of adjustable loft is at least about 3°), and a sole of the club head has a region 107 with boundaries that define a front plane 403 and a back plane 407 (both tangent to the sole) creating angles with the ground that together are at least about 3°.

Figure 29:
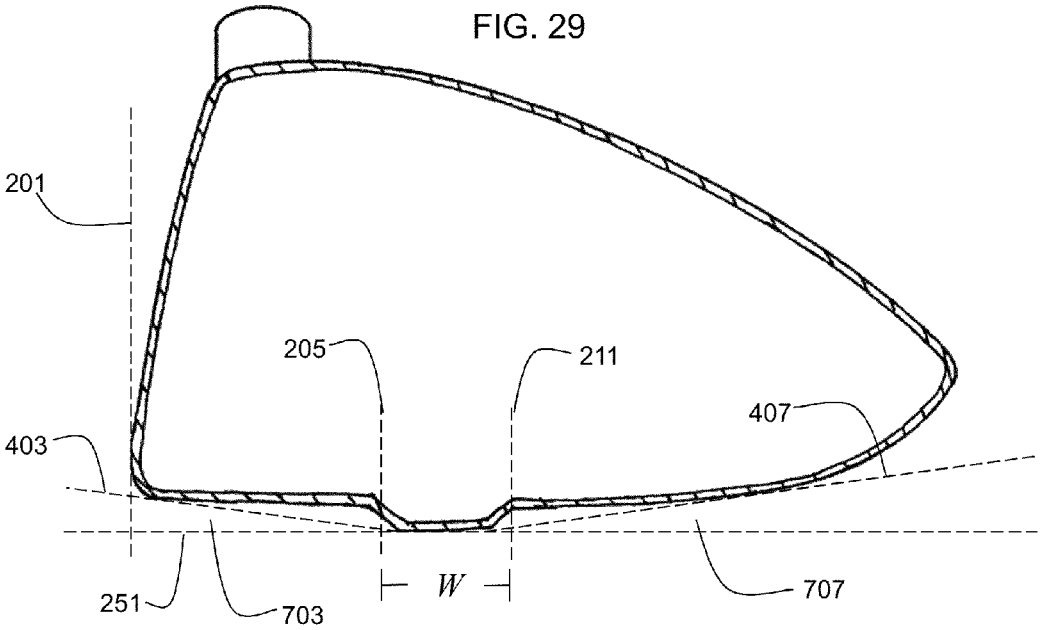
FIG. 29 is a cross-sectional view of a golf club head according to certain embodiments of the invention, taken along a line corresponding to line B-B' in FIG. 21.
Figure 30:
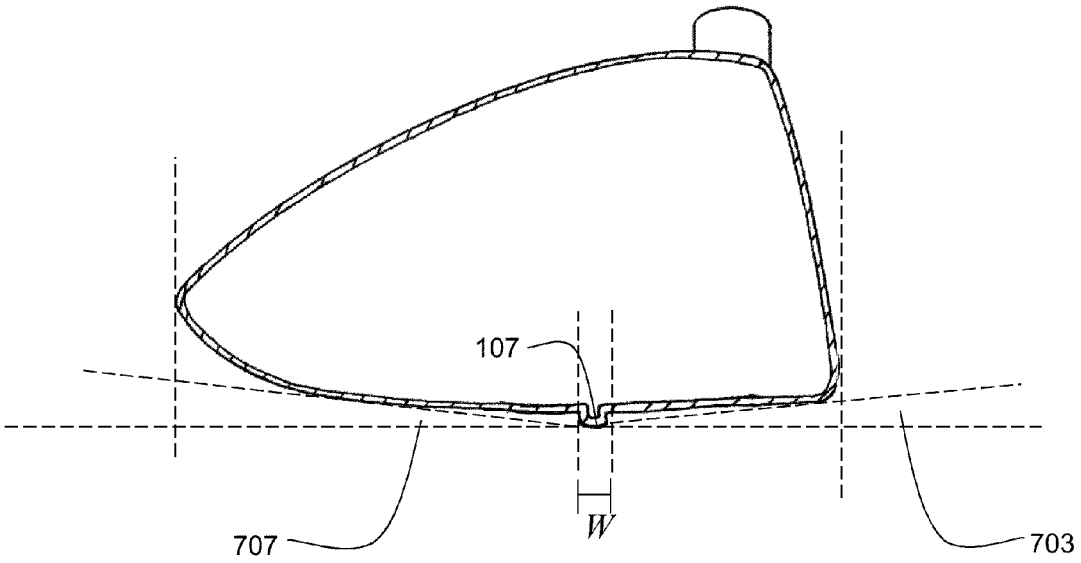
FIG. 30 is a cross-sectional view of a golf club head according to certain embodiments of the invention, taken along a line corresponding to line B-B' in FIG. 21.
Figure 31:
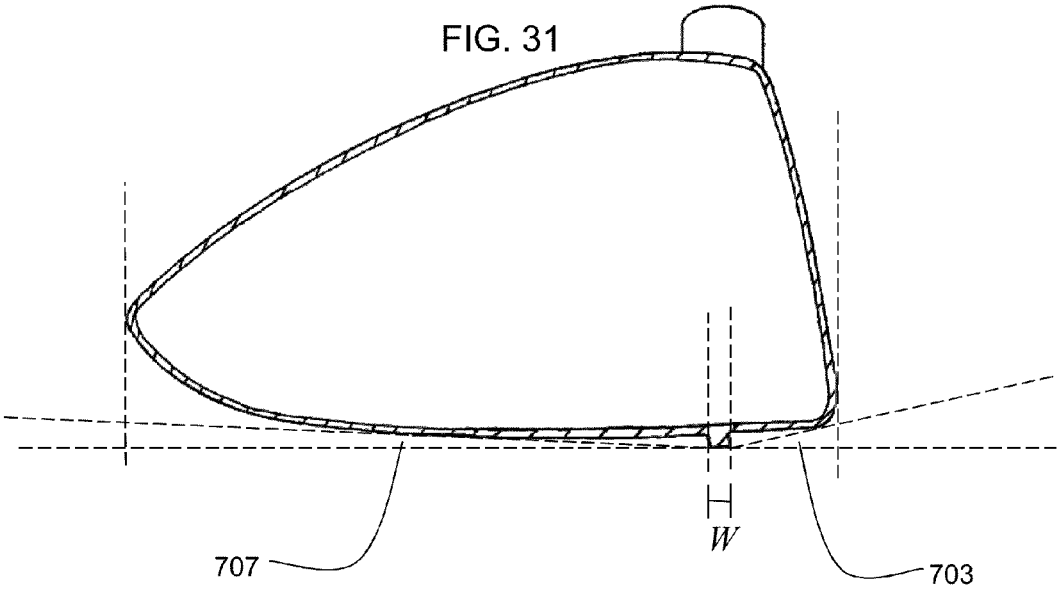
FIG. 31 is a cross-sectional view of a golf club head according to certain embodiments of the invention, taken along a line corresponding to line B-B' in FIG. 21.
Figure 32:
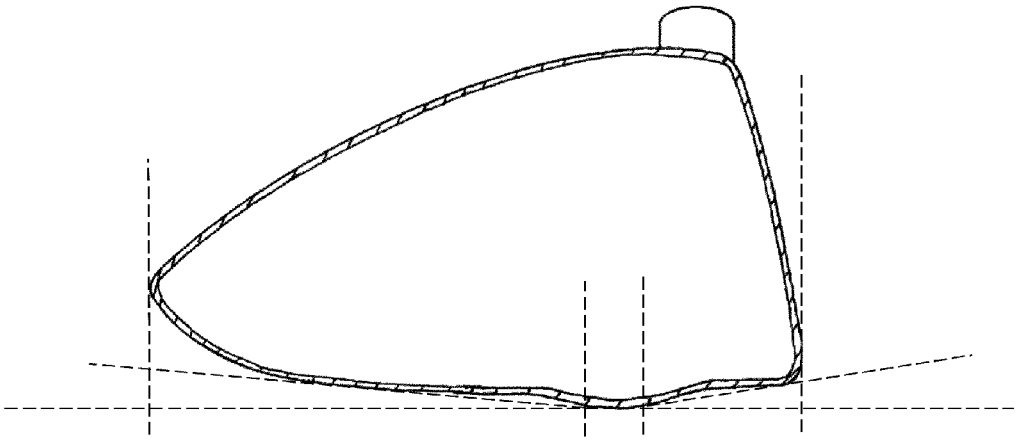
FIG. 32 is a cross-sectional view of a golf club head according to certain embodiments of the invention, taken along a line corresponding to line B-B' in FIG. 21.
Figure 33:
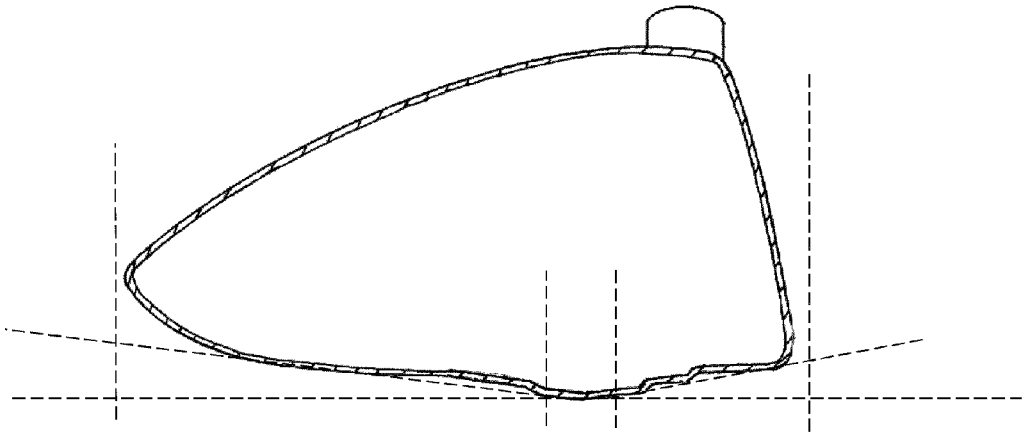
FIG. 33 is a cross-sectional view of a golf club head according to certain embodiments of the invention, taken along a line corresponding to line B-B' in FIG. 21.

FIG. 29 shows a cross sectional view illustrating one embodiment of the invention. As seen by comparing FIGS. 29-33, this geometry is attainable with various combinations of setback S and width W and morphologies of the sole of club head 101.

Figure 34:
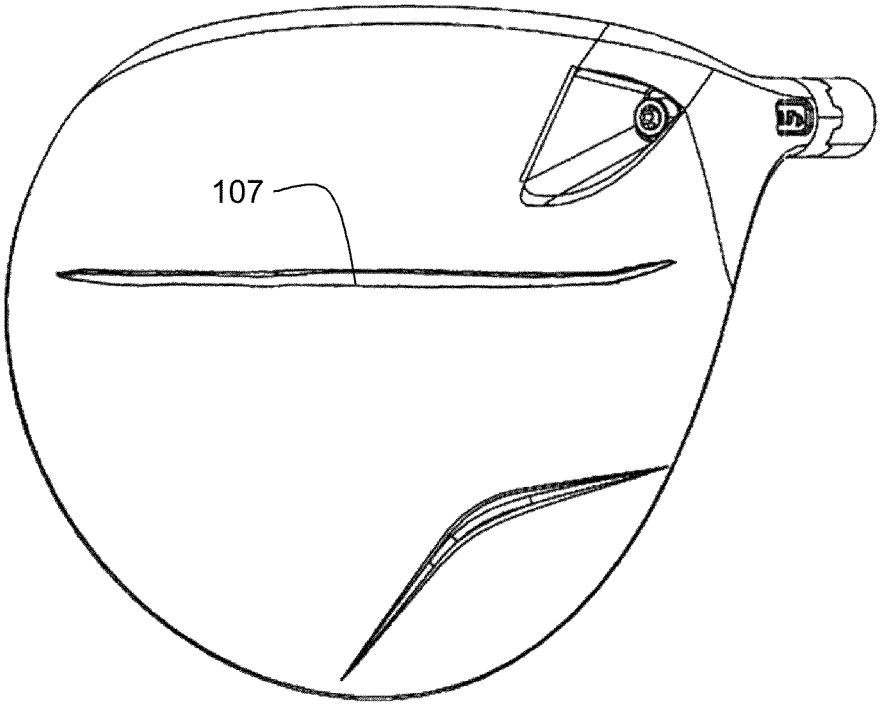
FIG. 34 is a bottom view of a golf club head according to certain embodiments of the invention.
Figure 35:
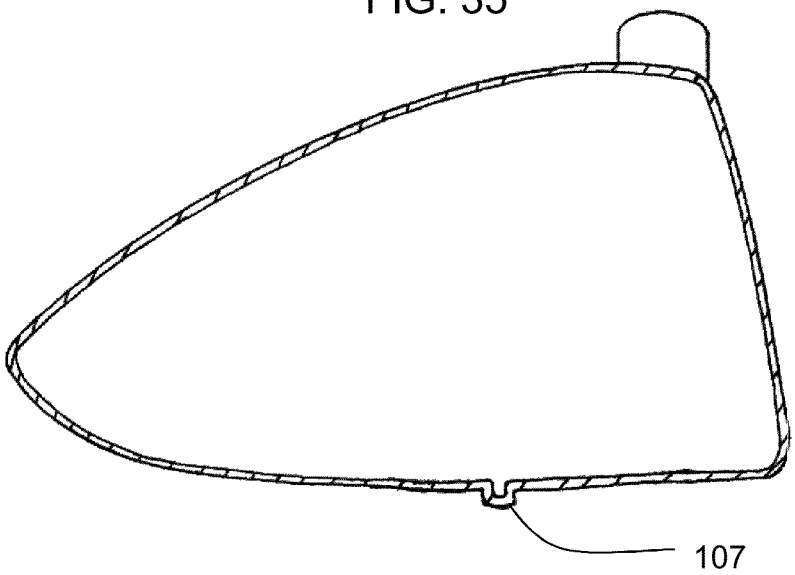
FIG. 35 is a cross-sectional view of a golf club head according to certain embodiments of the invention, taken along a line corresponding to line B-B' in FIG. 21.

Region 107 of club head 101 will generally satisfy at least one of the foregoing descriptions. A variety of embodiments are provided by the invention. For example, FIG. 34 shows a bottom view of club head 101 having a thin bar-like region 107 extending in a heel-toe direction. FIG. 35 shows a cross section view of a thin bar-like region 107. As shown in FIG. 34 or FIG. 35, region 107 can have a setback S between about 30 mm and about 35 mm or a width W between about 1 mm and about 9 mm.

Figure 36:
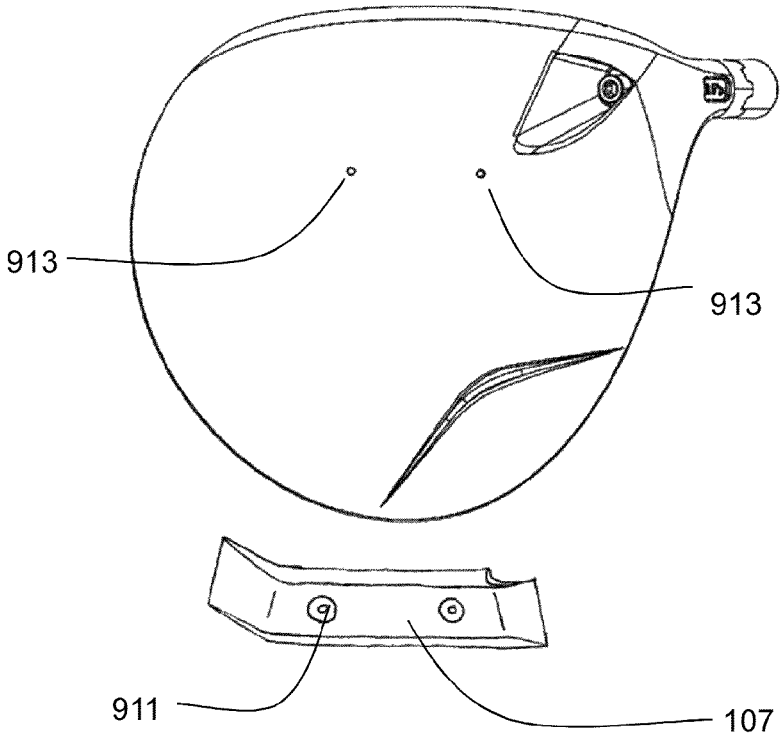
FIG. 36 is a bottom view of a golf club head with an attachable feature according to certain embodiments of the invention.
Figure 37:
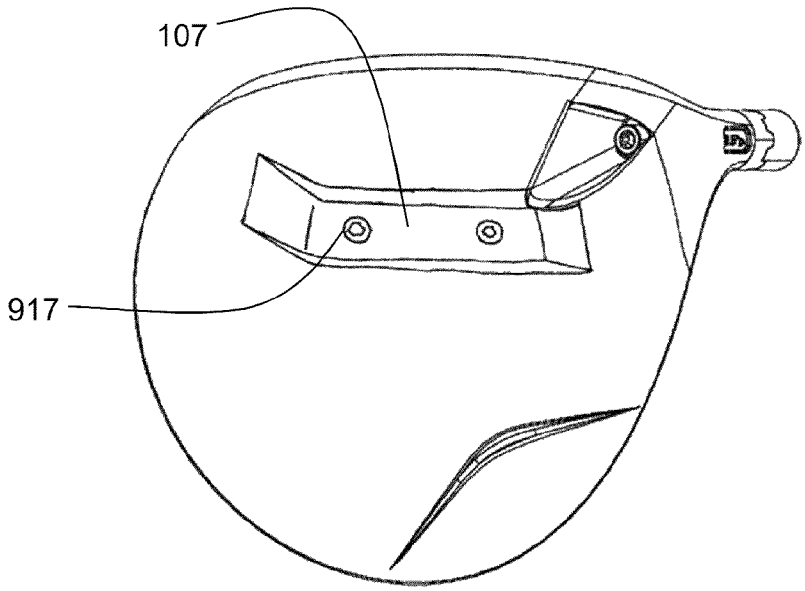
FIG. 37 is a bottom view of a golf club head with an attached feature according to certain embodiments of the invention.

In some embodiments, region 107 is provided by a separate component. For example, FIG. 36 shows a separate component providing region 107. The component has one or more fastening holes 911 positioned to correspond to anchor holes 913 on club head 101. FIG. 37 shows club head 101 having the component installed.

Figure 38:
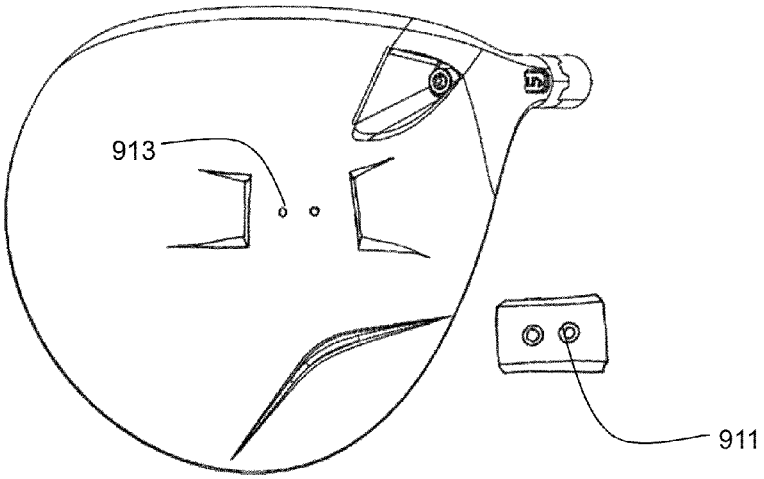
FIG. 38 is a bottom view of a golf club head with an attachable feature according to certain embodiments of the invention.
Figure 39:
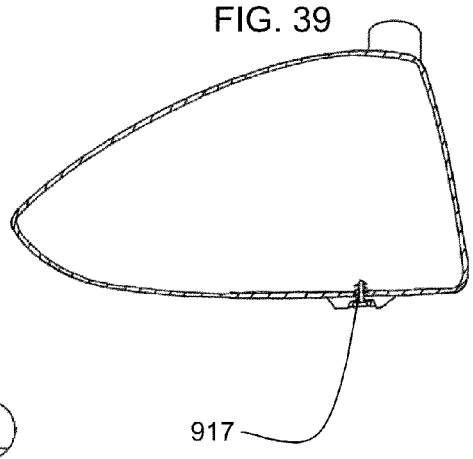
FIG. 39 is a cross-sectional view of a golf club head with an attached feature according to certain embodiments of the invention, taken along a line corresponding to line B-B' in FIG. 21.
Figure 40:
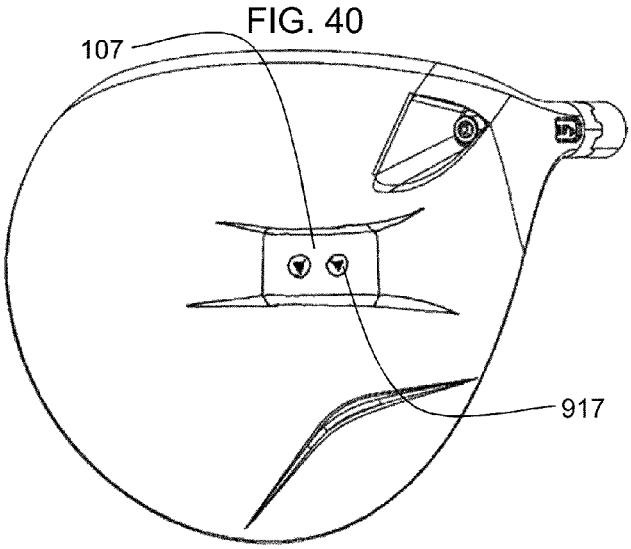
FIG. 40 is a bottom view of a golf club head with an attached feature according to certain embodiments of the invention.

In another example, FIG. 38 is a bottom view of a golf club head with an attachable feature according to certain embodiments of the invention. As shown in FIG. 38, the attachable component is configured to fit with one or more braze-ons or ramps (which may be welded, glued, riveted, molded, cast, or otherwise formed to club head 101). FIG. 39 shows a cross sectional view through fastening hole 911 and hardware element 917 (e.g., a screw or bolt) of club head 101 with attachable region 107 attached. FIG. 40 shows a bottom view of club head 101 with attachable region 107 attached. As shown in FIG. 40, region 107 may be biased, e.g., in a heel direction. For example, in the heel-toe direction, region 107 may begin near the center of the sole, and have a length L between about 1.5 cm and about 7.5 cm.

Figure 41:
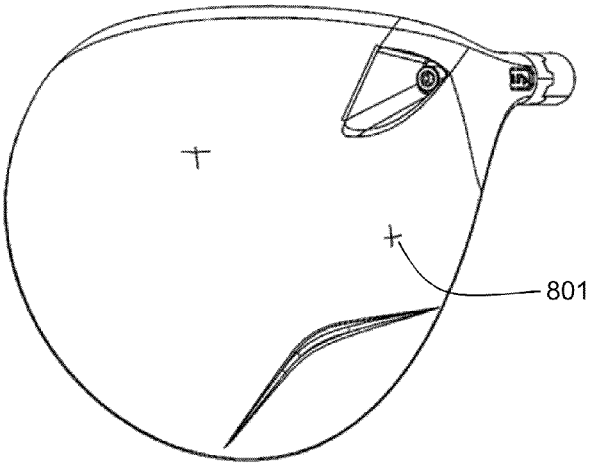
FIG. 41 is a bottom view of a golf club head with an attachable feature according to certain embodiments of the invention.
Figure 41:
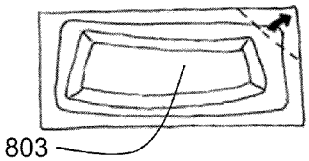
Figure 42:
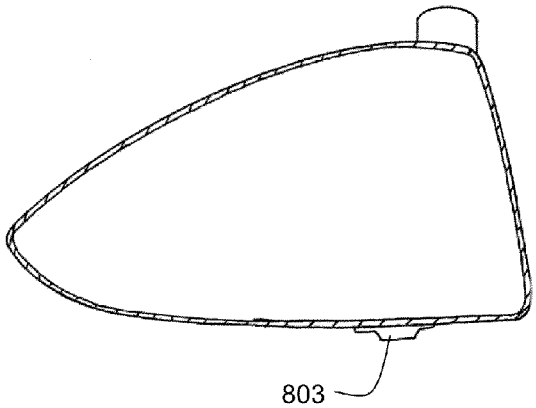
FIG. 42 is a cross-sectional view of a golf club head with an attached feature according to certain embodiments of the invention, taken along a line corresponding to line B-B' in FIG. 21.
Figure 43:
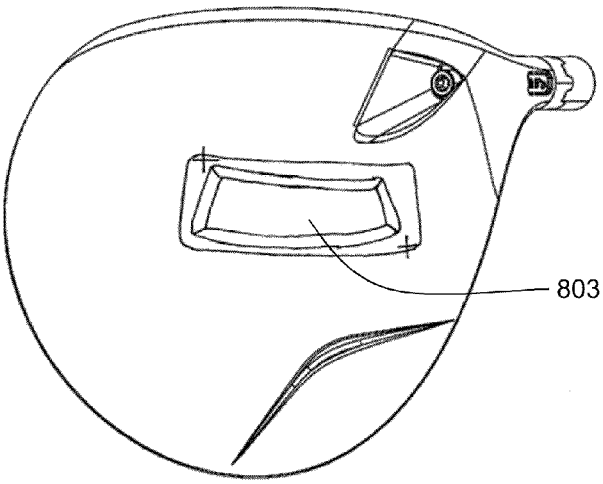
FIG. 43 is a bottom view of a golf club head with an attached feature according to certain embodiments of the invention.

In another example, FIG. 41 is a bottom view of a golf club head with an attachable feature according to certain embodiments of the invention. As shown in FIG. 41, region 107 is provided by an adhesive-backed element, here shown as a crack-and-peel accessory 803 (e.g., silicone polymer, rubber, molded or pliable plastic, cell phone, etc.). The sole of club head 101 can optionally be printed with registration marks 801 in any pattern, arrangement, color, or appearance, to show a suggested installation position for adhesive-backed accessory 803. FIG. 42 is a cross-sectional view showing installed accessory 803 to provide a region 107 meeting aspects of the region discussed above. FIG. 43 is a bottom view of club head 101 showing installed accessory 803.

Figure 44:
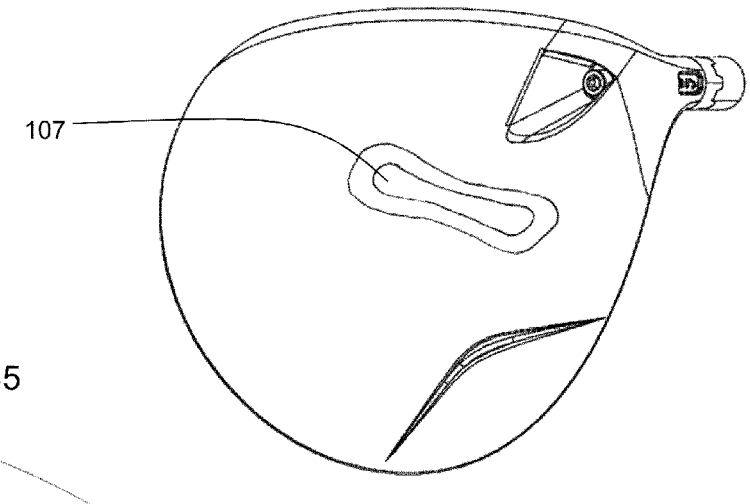
FIG. 44 is a bottom view of a golf club head according to certain embodiments of the invention.
Figure 45:
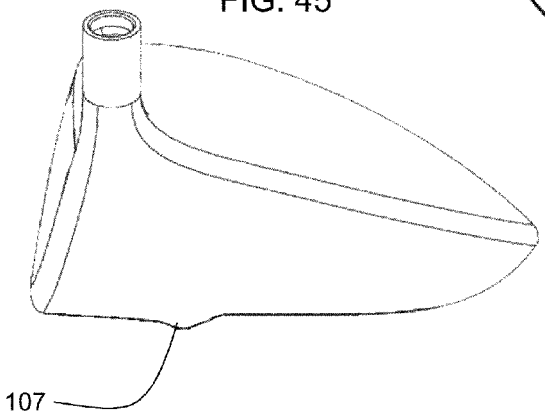
FIG. 45 is a side view of a golf club head according to certain embodiments of the invention.
Figure 46:
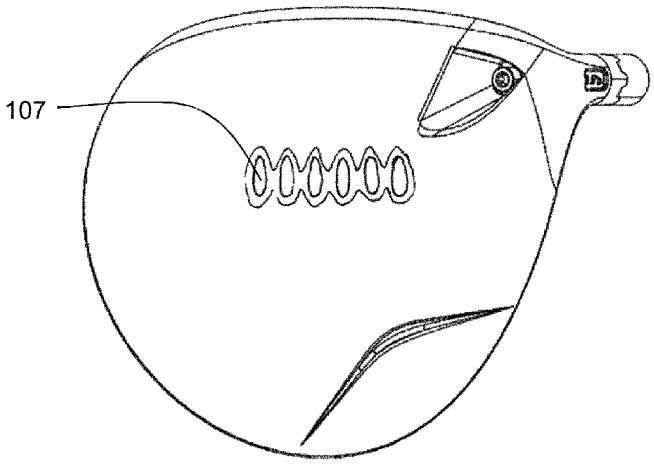
FIG. 46 is a bottom view of a golf club head according to certain embodiments of the invention.

FIGS. 44-46 show region 107 being provided by "irregular" or non-rectangular areas of contours on the sole of club head 101. The lines in FIG. 44 or FIG. 46 may represent contour lines and need not be visible as lines on a sole. As shown in FIG. 44, region 107 may be provided as a somewhat oblong bi-lobed shape. Region 107 could be oval or teardrop shaped or any other shape. FIG. 46 shows region 107 provided by about six substantially parallel tear-drop shaped contours, for example, to provide smooth turf interaction for club head 101.

Figure 47:
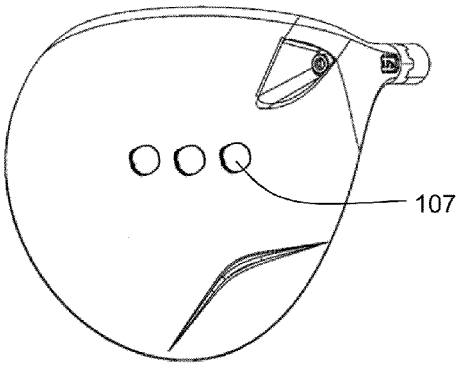
FIG. 47 is a bottom view of a golf club head according to certain embodiments of the invention.
Figure 48:
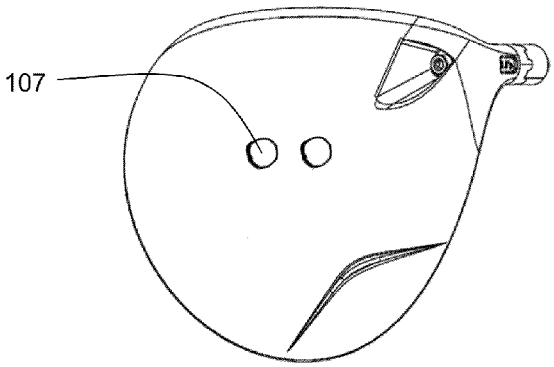
FIG. 48 is a bottom view of a golf club head according to certain embodiments of the invention.
Figure 49:
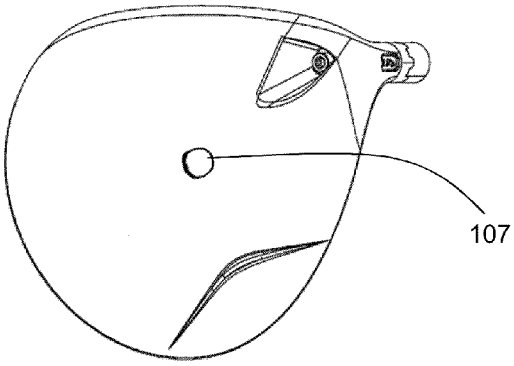
FIG. 49 is a bottom view of a golf club head according to certain embodiments of the invention.

FIGS. 47-50 show region 107 being provided by one or more discrete areas of relief. In FIGS. 47-50, a discrete area of relief is shown as a coin-shaped or button-like area, although any specific geometry is included in the invention. FIGS. 47, 48, and 49 show three, two, and one, respectively, areas of relief to provide region 107.

Figure 50:
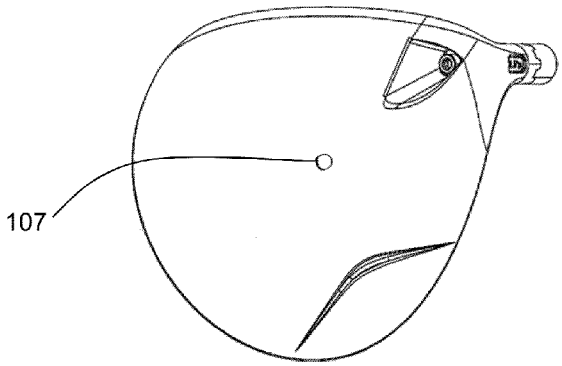
FIG. 50 is a bottom view of a golf club head according to certain embodiments of the invention.

FIG. 50 shows region 107 provided by a single small area of relief. Region 107 can have a length L between about 1 mm and about 5 mm, a width W between about 1 mm and about 5 mm, a height H between about 0.1 mm and about 3 mm, and setback S between about 5 mm and about 6 cm. Region 107 may provide fore angle 703 of X degrees and back angle 707 of Y degrees where each of X or Y may independently be between about 0.1° and about 8°, preferably between about 0.5° and about 4° (e.g., when club head is set at its centermost effective loft). Preferably, X+Y is between about 0.5° and about 7° in any loft setting. In some embodiments, region 107 is provided by a dot or "point-point" projection, i.e., having any height H described herein with an arbitrarily small length L and width W (e.g., less than about 1 mm).

Figure 51:
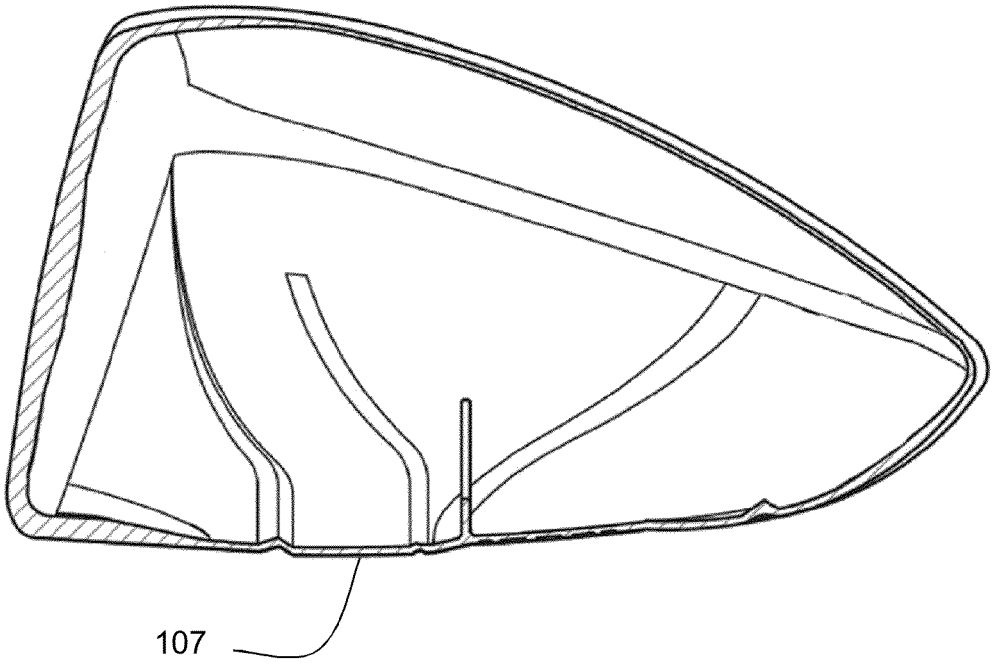
FIG. 51 is a cross-sectional view of a golf club head according to certain embodiments of the invention, taken along a line corresponding to line B-B' in FIG. 21.
Figure 52:
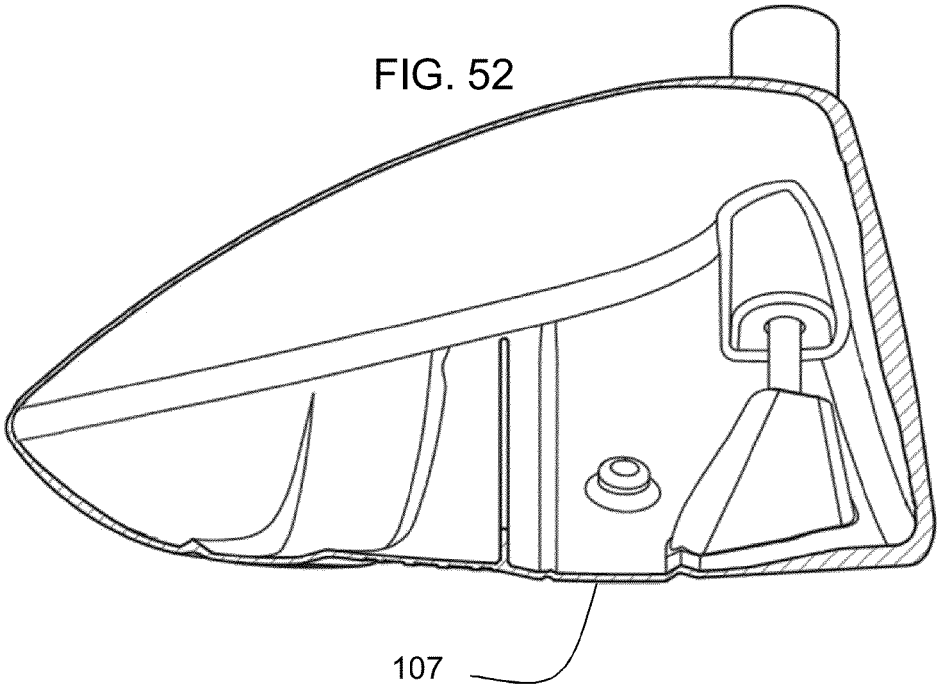
FIG. 52 is a cross-sectional view of a golf club head according to certain embodiments of the invention, taken along a line corresponding to line B-B' in FIG. 21.

FIGS. 51 and 52 each present a cross-sectional view of a golf club head according to certain embodiments of the invention, taken along a line corresponding to line B-B' in FIG. 21.

In various embodiments, region 107 is provided on drivers, hybrids, woods, and irons.

By providing a club head including a stabilizing element of the invention, a club can be made to provide a golfer with two or more reliable ranges for shot distances. To illustrate, a golfer may include in their bag the fourteen clubs listed in Table 7 to take advantage of the invention.

TABLE 7

Club set according to certain embodiments.

| Club | Distance range (yards) | Club | Distance range |
|---|---|---|---|
| 1 wood (driver) | 225-260 | 8 iron | 125-135 |
| 3 wood | 205-225 | 9 iron | 115-125 |

TABLE 7-continued

Club set according to certain embodiments.

| Club | Distance range (yards) | Club | Distance range |
|---|---|---|---|
| 19° hybrid | 195-205 | Pitch wedge | 105-115 |
| 22° hybrid | 175-185 | Gap wedge | 95-105 |
| 29°\|25° adj hybrid | 155-165, 165-175 | Sand wedge | 85-95 |
| 6 iron | 145-155 | Lob wedge | 75-85 |
| 7 iron | 135-145 | Putter | On the green |

The set shown in Table 7 includes an adjustable hybrid having at least two loft settings: 29° and 25°.

Golf rules generally allow fourteen clubs in a bag. Many golfers experience a distance-gapping problem only among or within certain parts of their sets. In some embodiments, the invention solves a golfer's distance-gapping problem by providing a set of golf clubs including fewer than fourteen clubs (e.g., two clubs, three clubs, four clubs, . . . ) for the golfer to use with other of their clubs to fill their bag. One insight of the invention is that the beneficial results of the set include the results provided by replacing the club that is "adjacent" to the distance-gap in a golfer's range list. Thus there is great value to many golfers in providing a set of two or three clubs, at least one of which is an adjustable club according to the invention.

For example, a golfer having the clubs listed in Table 1 may purchase a set including an adjustable wood and two adjustable hybrids. This golfer may then use this new set of adjustable clubs instead of their 3 wood, 5 wood, 3 iron, and 4 iron, to arrive at the clubs listed in Table 8.

TABLE 8

14 clubs including 3 adjustable clubs of invention.

| Club | Distance range (yards) | Club | Distance range |
|---|---|---|---|
| 1 wood (driver) | 225-260 | 8 iron | 125-135 |
| 4\|3 adj wood | 190-210, 205-225 | 9 iron | 115-125 |
| 19°\|16° adj hybrid | 185-205, 205-225 | Pitch wedge | 105-115 |
| 25°\|22° adj hybrid | 165-175, 175-185 | Gap wedge | 95-105 |
| 5 iron | 155-165 | Sand wedge | 85-95 |
| 6 iron | 145-155 | Lob wedge | 75-85 |
| 7 iron | 135-145 | Putter | On the green |

That is to say, a set of clubs according to the invention can be fewer than 14 or 14 clubs. Table 9 gives another exemplary set of 14 clubs according to the invention.

TABLE 9

Exemplary set of 14 clubs. Golfer may purchase only first 3 as set and may already own the other 11, or the golfer may purchase all 14 as a set.

| Club | Distance range (yards) | Club | Distance range |
|---|---|---|---|
| 1 wood (driver) | 225-260 | 8 iron | 125-135 |
| 3\|5 adj wood | 185-205, 205-225 | 9 iron | 115-125 |
| 25°\|22° adj hybrid | 165-175, 175-185 | Pitch wedge | 105-115 |
| 4 iron | 165-175 | Gap wedge | 95-105 |
| 5 iron | 155-165 | Sand wedge | 85-95 |
| 6 iron | 145-155 | Lob wedge | 75-85 |
| 7 iron | 135-145 | Putter | On the green |

In certain embodiments, a wood is provided in which the loft can be set at two or more effective settings including a setting at about 13° loft and a setting at about 16° (range of adjustable loft is at least about 3°), and a sole of the club head has a region 107 with boundaries that define a front plane 403 and a back plane 407 (both tangent to the sole) creating angles with the ground that together are at least about 3°. In certain embodiments, a hybrid is provided in which the loft can be set at two or more effective settings including a setting at about 16° loft and a setting at about 25° (range of adjustable loft is at least about 9°), and a sole of the club head has a region 107 with boundaries that define a front plane 403 and a back plane 407 (both tangent to the sole) creating angles with the ground that together are at least about 9°. In certain embodiments, an iron is provided in which the loft can be set at two or more effective settings and a sole of the club head has a region 107 with boundaries that define a front plane 403 and a back plane 407 (both tangent to the sole) creating angles with the ground that together are at least the difference between the two effective settings.

The inventive method of providing a set of golf clubs can be employed to beneficially improve a golfer's game. The method includes receiving information about a golfer and the hitting ranges with the golfer's clubs. With this information, one identifies a distance gap in the golfer's hitting ranges.

Then, one may select an adjustable club of the invention that covers the golfer's distance gap. A set of clubs including the selected club is provided to the golfer. Table 10 shows an exemplary set that may be provided to a hypothetical golfer by methods of the invention.

TABLE 10

Distance range for reliable shots by club for a hypothetical golfer

| Club | Distance range (yards) | Club | Distance range |
|---|---|---|---|
| 1 wood (driver) | 225-260 | 8 iron | 125-135 |
| 3 wood | 205-225 | 9 iron | 115-125 |
| 5 wood | 185-205 | Pitch wedge | 105-115 |
| 25°\|22° adj hybrid | 165-175, 175-185 | Gap wedge | 95-105 |
| 5 iron | 155-165 | Sand wedge | 85-95 |
| 6 iron | 145-155 | Lob wedge | 75-85 |
| 7 iron | 135-145 | Putter | On the green |

The method may be implemented through the use of a computer, either within a store or other facility or over the Internet. Thus in some embodiments, the method includes saving the information to a tangible, non-transitory memory operably coupled to a processor in a computer apparatus and using the processor in the identifying, determining, and selecting steps.

In certain aspects, the invention provides methods and systems for making, shipping, stocking, and selling golf clubs requiring only a single club head that satisfies consumer demand for different lofts and aesthetic features. For each of a plurality of customers, a golf club can be provided having a selected color, graphical depiction, loft, and/or face angle.

Due to the fact that a single club head of the invention can provide a club with a variety of features, such as color, graphics, and settings for loft or face angle, a store can stock fewer different club heads than would be required if only prior art club heads were available. Thus the invention allows for a configurable golf club to be provided that allows, for example, a store to sell golf clubs having a large number of configurations while only stocking a small number of club heads, shafts, and related hardware.

Accordingly, a golf club head having a sole with region 107 according to embodiments of the invention is provided for use with reconfigurable and interchangeable combinations of golf club parts (e.g., shafts, heads, ferrules, etc.). Mechanisms and methods for setting different club configurations are described in Interchangeable Shaft System, U.S. Pub. 2009/0197694; Interchangeable Shaft System, U.S. Pub. 2009/0264214; Interchangeable Shaft System, U.S. Pat. No. 7,699,717; Interchangeable Shaft System, U.S. Pub. 2011/0143854; Interchangeable Shaft and Club Head Connection System, U.S. Pat. No. 7,878,921; Interchangeable Shaft and Club Head Connection System, U.S. Pub. 2010/0261543; Interchangeable Shaft and Club head Connection System, U.S. Pub. 2009/0247316; Quick Release Connection System for Golf Clubs, U.S. Pub. 2008/0125239; Two-Part Hosel Connection System for Golf Clubs, U.S. Pub. 2008/0254909; and Interchangeable Shaft for a Golf Club, U.S. Pat. No. 7,476,160, the contents of each of which are herein incorporated by reference in their entirety.

Due to the fact that a club head of the invention prevents unwanted deviations from an intended orientation when held at address in different positions, a club head having a sole with region 107 according to embodiments of the invention is provided for use with any golf club (i.e., clubs that are not interchangeable, adjustable, or reconfigurable, as well as those that are). The invention provides a club head that can be permanently affixed to a shaft as well as other non-adjustable clubs.

Due to the fact that a club head of the invention enables a supplier (e.g., a store, pro-shop, wholesaler, sales rep, manufacturer, etc.) to offer a wider variety of clubs while stocking fewer independent parts, the invention provides the ability for a supplier to carry a greater variety of parts as defined by some other property, such as color, model, or trim level. For example, because a supplier can fit a customer with a driver having any loft and face angle using a single club head, a certain driver type can be provided for a large variety of customers using only a single stock-keeping unit (SKU) in a database or inventory system of the supplier. This means, relative to a supplier not using a club head of the invention, a large number of SKUs are "freed up" and can be used for other products. Similarly, a large amount of display space and storage space in the supply chain is likewise made available. Thus, these freed up resources can be used to provide clubs having, for example, a variety of colors.

Club heads of the invention enable suppliers to provide a variety of different clubs (e.g., requiring different SKUs, for example, one for each different color), where before, suppliers were limited to using those resources (SKUs and space) to carry enough versions of a single club head to satisfy the fitting requirements of a number of different customers.

The invention results in unexpected efficiencies in the manufacturing process because a club head can be brought to market having a variety of fits with only one form factor, a single manufacturing tool (e.g., mold) is required, thus lowering the cost of bringing a product to market. The single manufacturing tool can be used to produce club heads having a variety of colors, finishes, or "trim levels." Generally, trim level includes a brand name, decorative element, functional accessories, price, or combination thereof. For example, a driver may be sold having a single club head, but given both an SE and LE (e.g., "special edition" and "luxury edition") trim level, including silver stripes and a rubber grip on the SE model while having gold stripes, leather grip, and electronic components on the LE model. Also, the single manufacturing tool can be used to produce club heads having a variety of colors.

Because club heads that fit a variety of golfers can be made with a single tool, resources are freed to make club heads in a variety of colors and, more specifically, color can be provided in smaller runs, e.g., changed on a batch-by-batch basis. In some embodiments, the invention provides a set of club heads having a shared form factor and in a variety of colors. Club heads can be primary and secondary colors, fluorescent colors, regular or irregular patterns (e.g., plaid, speckled, tie-dyed, marbleized). Club heads can be made in limited runs having a distinctive color (e.g., the trademark color of a partnering luxury goods manufacturer or the trademark stripes or plaid pattern of a corporate partner).

Due to the fact that a manufacturer can offer a whole line of a particular club (e.g., a particular driver) to fit a variety of customers, by providing a single head, and that the color can be varied easily among the heads, manufacturers can offer distributors great flexibility and extensibility in the colors they offer to their customers. Due to this flexibility and extensibility, in certain embodiments, a retail store can offer clubs in small lots having truly customized colors. For example, a golf team or group can be provided with a set of clubs in which all of the club heads match the official colors of the group.

The invention provides personalized or customized color heads. Since all of a club head for a particular club can be provided by a single tool, manufacturing resources are greatly freed up by the invention. Thus, a manufacturer can repurpose its available resources, for example, to provide personalized customized color. In certain embodiments, a customer may choose a color (e.g., from a book, through an HTML color picker, etc.) or provide information about a color (e.g., provide a specimen, Pantone number, etc.) and a manufacturer can produce one or more club heads having the corresponding color.

A club head can be made having region 107 by any method known in the art. Club head 101 can be molded, cast, forged, or assembled from components by adhesives, welding, snap-fit, press-fit, or any other method known, or combination of any of the foregoing. Exemplary clubs and methods of making them are discussed in Multi-Piece Golf Club head with Improved Inertia, U.S. Pub. 2010/0056297; Golf Club Head with Moveable Insert, U.S. Pub. 2010/0105499; Golf Club Head, U.S. Pat. No. 7,803,065; Metal Wood Golf Club Head, U.S. Pub. 2008/0227564; Golf Club Head With Multi-Component Construction, U.S. Pub. 2011/0152003; Golf Club Heads, U.S. Pub. 2011/0151989; Method of Making Golf Clubs, U.S. Pub. 2011/0277313; and Method of Making Golf Clubs, U.S. Pub. 2010/0298065, the contents of each of which are hereby incorporated by reference in their entirety. Club head 101 can have any combination of one or more rib, weight, or other structural element beneficial to playability of the club.

A club head of the invention can include additional weights or moveable (e.g., rotatable or sliding) or interchangeable weight members, for example, to optimize a center of gravity or a moment of inertia of club head 101. Any method known in the art can be used to add adjustable weight or further functionalize club head 101. Rotatable members are described in Adjustable Golf Club, U.S. Pat. No. 2,593,368; Club Head with Movable Weight, U.S. Pat. No. 3,589,731; Weight Adjusting Structure of Golf Club Head, U.S. Pub. 2009/0215551; and Golf Club Head with Moveable Insert, U.S. Pub. 2010/0105499 (see, e.g., FIGS. 22-24); and Adjustable Golf Club, U.S. Pat. No. 4,735,414, the contents of each of which are herein incorporated by reference in their entirety. Non-rotatable (e.g., sliding, interchangeable, repositionable, etc.) mechanisms are described in Adjustable Weight Golf Clubs, U.S. Pub. 2008/0020861 and Golf Club Head with Alignment System, U.S. Pub. 2011/0190070 (see, e.g., FIG. 8), the contents of which are herein incorporated by reference in their entirety. Replaceable or interchangeable weight is described in Golf Club With Peripheral Weighting, U.S. Pat. No. 6,860,818, the contents of which are incorporated by reference herein in their entirety. Weight of club head 101 can be minimized, allowing weight to be re-distributed to other areas, through the use of lightweight inserts. Weight-saving inserts are described in Golf Club With Concave Insert, U.S. Pub. 2011/0275455, the contents of which are incorporated herein by reference in their entirety.

INCORPORATION BY REFERENCE

References and citations to other documents, such as patents, patent applications, patent publications, journals, books, papers, web contents, have been made throughout this disclosure. All such documents are hereby incorporated herein by reference in their entirety for all purposes.

EQUIVALENTS

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

What is claimed is:

1. A set of golf clubs comprising:

a plurality of golf clubs, each having an extended shaft with a club head and a grip on opposing ends thereof, wherein at least one club is an adjustable club comprising:

an adjustment mechanism operable to confer on the adjustable club one of two or more effective loft settings, and a stabilizing mechanism operable to provide the adjustable club with the same heel-toe face angle while having any of the two or more effective loft settings, wherein the stabilizing mechanism comprises a pad protruding from a sole of the club head by a height H, having a maximum length L, a maximum width W, and a setback S from a front-most point on a club face of the club head when the adjustable club including the club head is at address, wherein S is more than 1 mm, L is more than 1 mm, W is more than 1 mm, and H is between 0.3 mm and 2 mm, wherein, in at least two of the two or more effective loft settings, the adjustable club, when at address, balances with a neutral heel-toe face angle due to the pad protruding from the sole of the club head by the height H that is between 0.3 mm and 2 mm.

2. The set of claim 1, wherein:

S is between about 1 cm and about 3 cm;

L is between about 2 cm and about 13 cm;

W is between about 1 mm and about 3 cm; and

H is between about 0.5 mm and about 1.2 mm.

3. The set of claim 1, further wherein the adjustable club is configured such that, when held address in any of the two or more effective loft settings, the club head makes contact with the ground only within the stabilizing element.

4. The set of claim 1, wherein the adjustable club is one selected from the list consisting of wood, hybrid, and iron.

5. The set of claim 1, wherein the set comprises at least one wood, at least one hybrid, and at least one iron.

* * * * *